US009843142B2

(12) United States Patent
Hack et al.

(10) Patent No.: US 9,843,142 B2
(45) Date of Patent: Dec. 12, 2017

(54) CONNECTOR RECEPTACLE HAVING GOOD SIGNAL INTEGRITY

(71) Applicant: Apple Inc., Cupertino, CA (US)

(72) Inventors: Paul J. Hack, San Jose, CA (US); George Tziviskos, Cupertino, CA (US); Zheng Gao, San Jose, CA (US)

(73) Assignee: APPLE INC., Cupertino, CA (US)

( * ) Notice: Subject to any disclaimer, the term of this patent is extended or adjusted under 35 U.S.C. 154(b) by 65 days.

(21) Appl. No.: 14/870,884

(22) Filed: Sep. 30, 2015

(65) Prior Publication Data

US 2016/0099524 A1 Apr. 7, 2016

Related U.S. Application Data

(60) Provisional application No. 62/057,943, filed on Sep. 30, 2014.

(51) Int. Cl.

| | |
|---|---|
| ***H01R 9/03*** | (2006.01) |
| ***H01R 13/6583*** | (2011.01) |
| ***H01R 13/6585*** | (2011.01) |
| ***H01R 24/60*** | (2011.01) |
| ***H01R 43/24*** | (2006.01) |

(52) U.S. Cl.
CPC ..... *H01R 13/6583* (2013.01); *H01R 13/6585* (2013.01); *H01R 24/60* (2013.01); *H01R 43/24* (2013.01)

(58) Field of Classification Search
CPC H01R 13/6585; H01R 13/6583; H01R 24/60; H01R 43/24
USPC ..... 439/79, 607.35, 607.27, 607.4, 607.55
See application file for complete search history.

(56) References Cited

U.S. PATENT DOCUMENTS

| | | | | |
|---|---|---|---|---|
| 9,281,643 | B1 * | 3/2016 | Tseng | H01R 13/518 |
| 9,325,128 | B2 * | 4/2016 | Chen | H01R 12/724 |
| 9,444,199 | B2 * | 9/2016 | Leng | H01R 13/6596 |
| 9,450,341 | B2 * | 9/2016 | Kao | H01R 13/6585 |
| 9,466,924 | B2 * | 10/2016 | Lin | H01R 13/6585 |

* cited by examiner

*Primary Examiner* — Khiem Nguyen
(74) *Attorney, Agent, or Firm* — Kilpatrick Townsend & Stockton, LLP

(57) ABSTRACT

Connector receptacles that have good signal integrity, are reduced in size, are reliable and durable, and are easy to assemble. One example may provide a connector receptacle having several ground connections to improve signal integrity and quality.

20 Claims, 31 Drawing Sheets

CONNECTOR RECEPTACLE HAVING GOOD SIGNAL INTEGRITY

CROSS-REFERENCES TO RELATED APPLICATIONS

This application is a nonprovisional of and claims priority to U.S. patent provisional application No. 62/057,943, filed Sep. 30, 2014, which is incorporated by reference.

BACKGROUND

The number and types of electronic devices available to consumers have increased tremendously the past few years, and this increase shows no signs of abating. Electronic devices, such as portable media players, storage devices, tablets, netbooks, laptops, desktops, all-in-one computers, wearable computing devices, cell, media, and smart phones, televisions, monitors, and other display devices, navigation systems, and other devices have become ubiquitous.

These devices often receive and provide power and data using various cable assemblies. These cable assemblies may include connector inserts, or plugs, on one or more ends of a cable. The connector inserts may plug into connector receptacles on electronic devices, thereby forming one or more conductive paths for signals and power.

The connector receptacles may be formed of housings that typically at least partially surround and provide mechanical support for contacts. These contacts may be arranged to mate with corresponding contacts on the connector inserts or plugs to form portions of electrical paths between devices.

Data rates for signals conveyed over these electrical paths have increased. Data rates in the hundreds of megahertz are now being used. Also, the number of signal paths in connector receptacles and inserts has also increased. The advent of higher data rates combined with an increasing signal density may compromise integrity and quality of signals in these connectors. Accordingly, it may be desirable to provide connector receptacles having an improved signal integrity.

Also, these receptacles consume space inside the electronic device. This consumed space may mean that the device may become larger, some functionality may be lost, or that some tradeoff may have to be made. These losses may be mitigated by reducing the size of the connector receptacle. It may also be desirable that these receptacles be reliable since they may be used many times during a device's life. Also, since many such receptacles may be needed over a product's lifetime, it may be desirable that these receptacles be simple to assemble.

Thus, what is needed are connector receptacles that have a good signal integrity, are reduced in size, are reliable and durable, and are easy to assemble.

SUMMARY

Accordingly, embodiments of the present invention may provide connector receptacles that have good signal integrity, are reduced in size, are reliable and durable, and are easy to assemble. An illustrative embodiment of the present invention may provide a connector receptacle having several ground connections to improve signal integrity and quality. For example, the connector receptacle may include side ground contacts that may electrically connect to side ground contacts on a connector insert. The receptacle may further have ground contacts near a front opening. These ground contacts may electrically connect to a ground ring or pad on the connector insert. A ground plane between top and bottom rows of contacts in the receptacle may be included to form a ground path with a front ground pad or ground ring on the insert and to isolate signals conveyed by the top row from signals conveyed by the bottom row of contacts. A shield for the receptacle may be formed as a single piece using a deep drawing process, as opposed to being stamped and folded. Such a shield may limit a number of gaps and openings in the shield to prevent high-frequency signal leakage into and out of the receptacle. Other techniques, such as using foil shielding at openings in the shield may be used to further reduce high-frequency leakage. Pairs of contacts conveying differential signal pairs may have adjacent contacts on each side of the pair that are connected to an AC ground. This ground arrangement may act as a strip-line to further improve signal integrity and quality of differential pair signals.

An illustrative embodiment of the present invention may provide a connector receptacle that may have be reliable and durable despite having a reduced size. The connector receptacle may have a housing formed of two or more interlocking parts. These interlocking parts may provide reinforcement and support for housing and shields that may have a reduced thickness. The interlocking may be facilitated with tabs and openings on different structures. These various tabs and openings may also provide a connector receptacle that may be readily assembled during manufacturing.

An illustrative embodiment of the present invention may provide a connector receptacle having a housing having a front side opening and two side openings. A top row of contacts may be located in a top side of the housing near the front side opening and a bottom row of contacts may be located in a bottom side of the housing near the front side opening. A ground contact between the top row of contacts and the bottom row of contacts may be included to form a ground connection with a front of a connector insert. The receptacle may further include two side ground contacts, one on each side of the housing, each having a contact portion exposed at a side opening of the housing. A shield may substantially surround the housing and side ground contacts, wherein the housing has a front guide portion defining the front side opening and extending forward beyond the shield. The shield may provide reinforcement for the side ground contacts, thereby increasing the retention force they provide. The shield may include a plurality of extensions extending from a front edge of the shield and folded to fit in openings in the front guide portion of the housing. These extensions may form ground contacts to mate with a ground ring on a connector insert. The shield may be notched near the extension to increase the flexibility of the resulting ground contacts. Openings in a top and bottom of the shield may be located over each of the contacts in the top and bottom rows. These openings may provide room for the contacts to deflect when a connector insert is inserted into the connector receptacle. Layers of insulating material metallic foil may be placed between the top row of contacts and the top shield portion and between the bottom row of contacts and the bottom shield portion. In various embodiments of the present invention, the shield may be formed using a deep drawn manufacturing process.

The contacts may each include a beam portion and a through-hole portion. The beam portions may be located in a front portion of the housing. The through-hole portions may be at least partially located in a rear interlocking portion of the housing. The contacts may be formed using a copper-nickel-silicon alloy or other type of material.

Another illustrative embodiment of the present invention may provide a method of assembling a connector receptacle. This method may include forming a first mold around a first plurality of contacts, forming a second mold around a second plurality of contacts, aligning a ground plane portion between the first mold and the second mold, and attaching the first mold to the second mold. The method may further include inserting contact tails for the first plurality of contacts, the ground plane portion, and the second plurality of contacts into a rear housing portion, inserting beam portions of the first plurality of contacts, the ground plane portion, and the second plurality of contacts into a front housing portion, and attaching the front housing portion to the rear housing portion. Side ground contacts may be included by inserting side ground contacts into sides of the rear housing portion. A shell or shield may be formed by placing a top shield portion over a top of the attached front and rear housings and attaching a bottom shield portion under the attached front and rear housings. The shield may provide reinforcement for the side ground contacts, thereby increasing the retention force that they provide.

Another illustrative embodiment of the present invention may provide a connector receptacle. This connector receptacle may include a front housing portion attached to a rear housing portion. A first mold may be formed around a first plurality of contacts and a second mold may be formed around a second plurality of contacts, and the second mold may be attached to the first mold. A ground plane portion may be included between the first mold and the second mold and attached to the first mold to the second mold. A plurality of side ground contacts may be inserted into sides of the rear housing portion. A shell or shield may be formed by a top shield portion placed over a top of the attached front and rear housings and a bottom shield portion placed under the attached front and rear housings and attached to the top shield portion. Portions of contact tails for the first plurality of contacts, the ground plane portion, and the second plurality of contacts may be located in passages in the rear housing portion. Beam portions of the first plurality of contacts, the ground plane portion, and the second plurality of contacts may be located in the front housing portion.

In various embodiments of the present invention, the components of the receptacles may be formed in various ways of various materials. For example, contacts or pins and other conductive portions of the receptacles may be formed by stamping, metal-injection molding, machining, micromachining, 3-D printing, or other manufacturing process. The conductive portions may be formed of stainless steel, steel, copper, copper titanium, phosphor bronze, a copper-nickel-silicon alloy, or other material or combination of materials. The conductive portions, such as the shields, may be joined together using soldering, spot or laser welding, or other technique. The conductive portions may be plated or coated with nickel, gold, or other material. The nonconductive portions, such as the protective pieces, the receptacle housings and other portions, may be formed using injection or other molding, 3-D printing, machining, or other manufacturing process. The nonconductive portions may be formed of silicon or silicone, rubber, hard rubber, plastic, nylon, elastomers, liquid-crystal polymers (LCPs), ceramics, or other nonconductive material or combination of materials.

Embodiments of the present invention may provide receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connector receptacles may provide pathways for signals and power for cards or other modules, such as Secure Digital cards, Secure Digital High Capacity cards, Secure Digital Extended Capacity cards, Secure Digital Ultra-High-Capacity I cards, Secure Digital Ultra-High-Capacity II cards, memory sticks, compact flash cards, communication modules, and other devices and modules that have been developed, are being developed, or will be developed in the future. These connector receptacles may provide pathways for signals that are compliant with various standards such as Universal Serial Bus (USB), High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
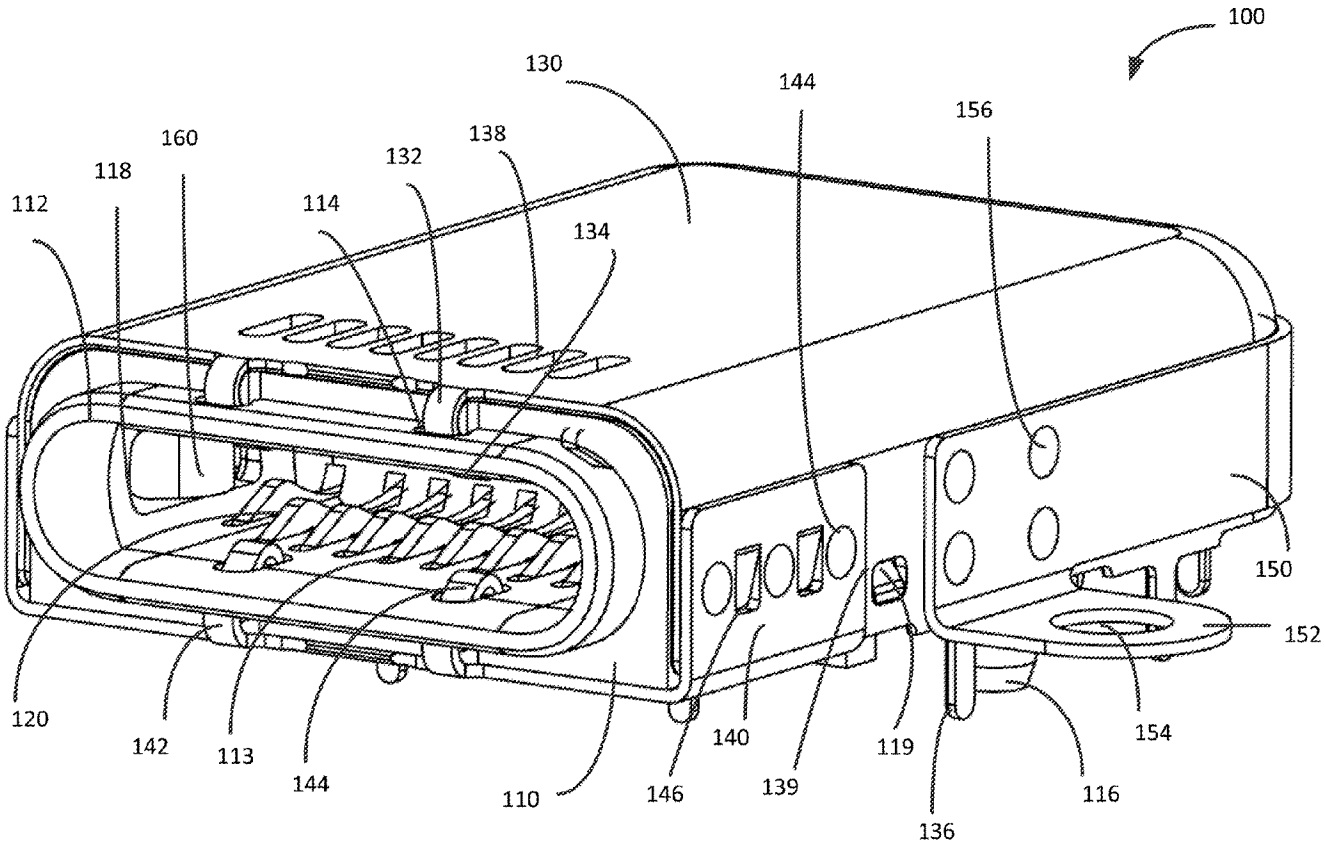
FIG. 1 illustrates a first connector receptacle according to an embodiment of the present invention.

FIG. 1 illustrates a connector receptacle according to an embodiment of the present invention. This figure, as with the other included figures, is shown for illustrative purposes and does not limit either the possible embodiments of the present invention or the claims.

Connector receptacle 100 may include housing 110 having a front guide 112 forming a front opening. A connector insert may be inserted into the connector receptacle via the opening in front guide 112. A number of contacts 120 may be located in slots or passages 113 in housing 110. Side ground contacts 160 may be exposed at side openings 118 in housing 110. Housing 110 may include posts 116. Posts 116 may be placed in openings of a printed circuit board, device enclosure, or other appropriate substrate for mechanical stability.

Connector receptacle 100 may be at least partially covered on a top side by top shell or top shield portion 130. Extensions 132 may extend from a front of top shield portion 130 away from a front of the connector receptacle 100. Extensions 132 may be folded over and passed through openings 114 in front guide 112 to form contacts 134. Contacts 134 may be ground contacts to form an electrical connection with a ground path or ground ring on a connector insert. Shield portion 130 may also include openings 138. Openings 138 may provide room for the deflection of contacts 120 when a connector insert is inserted into the connector receptacle 100. When top shield portion 130 is fitted over housing 110, opening 139 on top shield portion 130 may accept tab 119 on housing 110. Similar tabs may be located on an opposing side and rear of connector receptacle 100. These tabs 119 and openings 139 may hold top shield portion 130 in place relative to housing 110. Top shield portion 130 may further include tabs 136. Tabs 136 may be inserted into openings and connected to ground pads or traces in a printed circuit board or other appropriate substrate in an electronic device housing connector receptacle 100. Top shield portion 130 may provide reinforcement for side ground contacts 160. This reinforcement may increase the retention force that the side ground contacts 160 provide.

Connector receptacle 100 may include a first bottom shield portion 140. Bottom shield portion 140 may include tabs 146 that may fit in openings in top shield portion 130 in order to secure bottom shield portion 140 to top shield portion 130. Similar to top shield portion 130, bottom shield portion 140 may include extensions 142. Extensions 142 may be passed through openings 114 in front guide portion 112 to form contacts 144. Contacts 144 may be ground contacts to form a ground connection with a ground pad or ground ring on a connector insert. First bottom shield portion 140 may be fixed to top shield portion 130 by spot or laser welding at points 144. First bottom shield portion 140 may include openings similar to openings 138.

Connector receptacle 100 may also include a second bottom shield portion 150. Bottom shield portion 150 may include flanges 152 having openings 154. Openings 154 may accept a fastener such that connector receptacle 100 may be secured to a printed circuit board, device enclosure, or other appropriate substrate or structure. Second bottom shield portion 150 may be fixed to top shield portion 130 by spot or laser welding at points 156.

In this and the other embodiments of the present invention, one or more of these shield portions may be formed using a deep drawn process. This deep drawn process may result in a heavy duty shield portion having fewer openings as opposed to a conventional stamping, folding, and bending process.

Again, signals conveyed on contacts 120 may have a high data rates. Also, a relatively large number of signals may be packed into a fairly small connector receptacle 100. Accordingly, this and the other embodiments of the present invention may utilize various techniques for improving grounding. For example, ground contacts 134 and 144 may be included to electrically connect to ground pads or a ground ring on a connector insert. Side ground contacts 160 may also be provided. Side ground contacts 160 may form ground connections with ground pads or a ground ring at the sides of a connector insert. Again, shield portions 130, 140, and 150 may be deep drawn to reduce openings and sharp angles. These ground portions may be interlocked using openings and tabs and attached using spot or laser welding as well. As will be seen below, foil layers may be used to prevent high frequency leakage through openings 138. Also, a mid-opening ground plane may be located in the front opening of connector receptacle 100. Side ground contacts 160 may provide a retention force that pulls a connector insert into contact with the mid-opening ground plane, and this retention force may be increased by the reinforcement provided by the top and bottom shield portions. Further, contacts 120 may be used to convey differential signals. Typically, the differential signals may be located on adjacent contacts or pins. Contacts for AC signal grounds may be placed on each side of these adjacent contacts or pins. These AC grounds may include ground, power supplies, control lines, and other path having a low impedance to ground.

To further improve the signal integrity and quality, contacts 120 may be formed using a low impedance material.

For example, an alloy of copper-nickel-silicon may be used. The resulting contacts 120 may have a lower impedance but may have a reduced beam spring force. Accordingly, embodiments of the present invention may compensate for this by using slightly longer contacts 120 than may otherwise be used. These longer contacts may have stronger beam force while maintaining a lower contact resistance.

Figure 2:
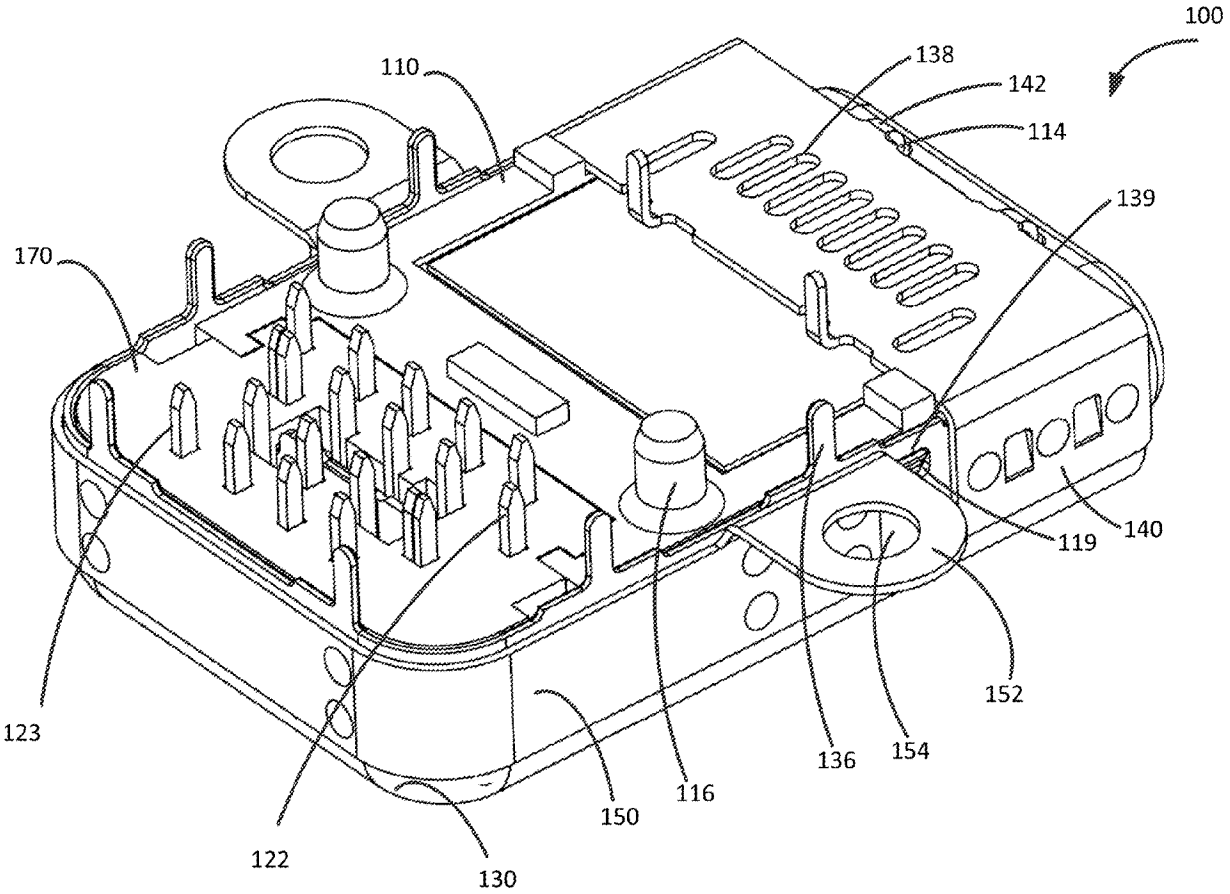
FIG. 2 illustrates an oblique bottom side view of the connector receptacle of FIG. 1.

FIG. 2 illustrates an oblique bottom side view of the connector receptacle of FIG. 1. Contact tails 122 for a bottom row of contacts 120 and contact tails 123 for a top row of contacts may emerge from an underside of a rear housing portion 170. Contact tails 122 and 123 may be through-hole contact tails which may be inserted into openings in a printed circuit board or other appropriate substrate. In other embodiments of the present invention, other types of contacts, such as surface mount contacts, may be used.

A top shield portion 130 may be attached to bottom shield portions 140 and 150. Bottom shield portion 140 may include openings 138, which may be similar to openings 138 on a top side of connector receptacle 100. Extensions 142 may extend from bottom shield 140 and may pass through opening 114 to form ground contacts is shown above. Posts 116 and tabs 136 may also emerge from a bottom of connector receptacle 100. Posts 116 may be placed in openings in a printed circuit board or other substrate for mechanical stability. Tabs 136 may be placed in openings connected to ground traces or planes in a printed circuit board or other substrate. Bottom shield piece 150 may include flanges 152 having fastener openings 154.

Figure 3:
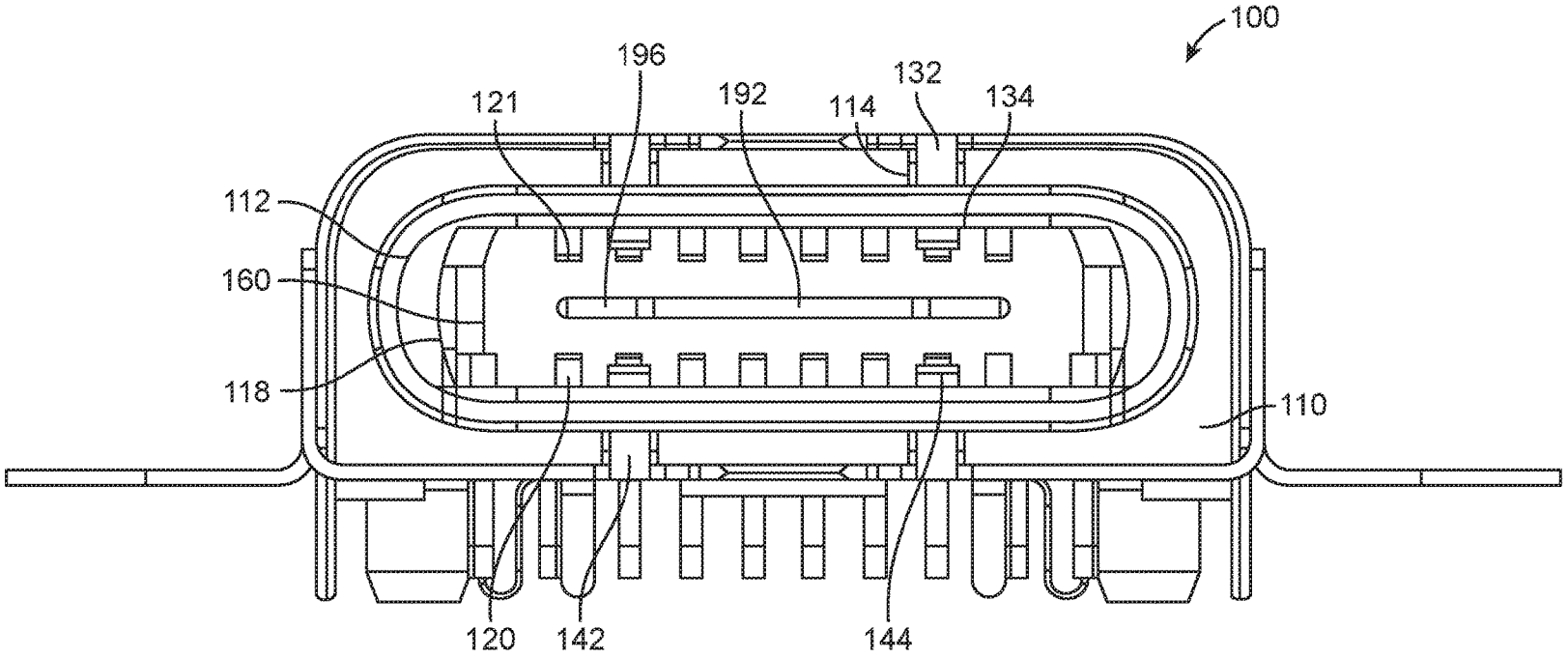
FIG. 3 illustrates a front view of the connector receptacle of FIG. 1.

FIG. 3 illustrates a front view of the connector receptacle of FIG. 1. Housing 110 may have an opening in a front guide 112 into which a connector insert may be inserted. Connector receptacle 100 may include a top row of contacts 121 and a bottom row of contacts 120. Extensions 132 and 142 may be inserted through openings 114 and folded back to form ground contacts 134 and 144. Side ground contacts 160 may be available at side openings 118 in housing 110.

A center ground plane or ground contact 192 may also be included. The center ground plane or ground contact may form a ground connection with a pad or ground ring on a front of a connector insert when the connector insert is inserted into connector receptacle 100. Ground plane or ground contact 192 may include ground contacts 196. These ground contacts 196 on the sides of ground plane 192 may help to maintain a ground connection when a connector insert is inserted into connector receptacle 100 at an angle. When a connector insert is inserted into connector receptacle 100, side ground contacts 160 may provide a force pulling the connector insert into connector receptacle 100. This force may be increased by the reinforcement provided by the various shield portions. This may assist in maintaining a ground connection between ground contacts 196 on ground plane 192 and the ground pad or ground ring at the front of a connector insert.

Figure 4:
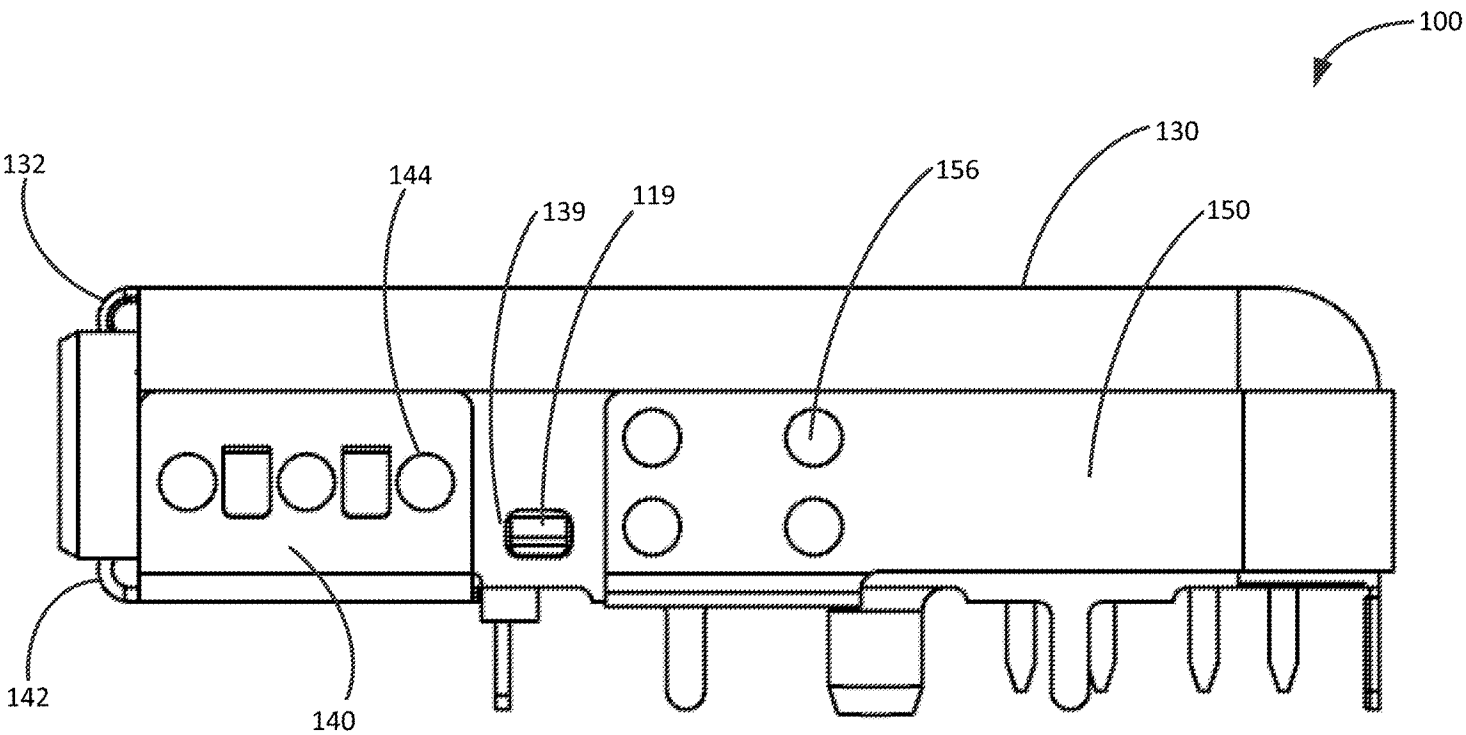
FIG. 4 illustrates a side view of the connector receptacle of FIG. 1.

FIG. 4 illustrates a side view of the connector receptacle of FIG. 1. Extensions 132 from top shield 130 may be folded into a front opening of connector receptacle 100. Similarly, extensions 142 of a first bottom shield portion 140 may be folded into a front opening of connector receptacle 100. Top shield portion 130 may be secured to a housing 110 by aligning opening 139 in top shield portion 130 with tab 119 on a side of housing 110. First bottom shield portion 140 may be attached to top shield portion 130 at points 144. Similarly, a second bottom shield portion 150 may be attached to top shield portion 130 at points 156.

Figure 5:
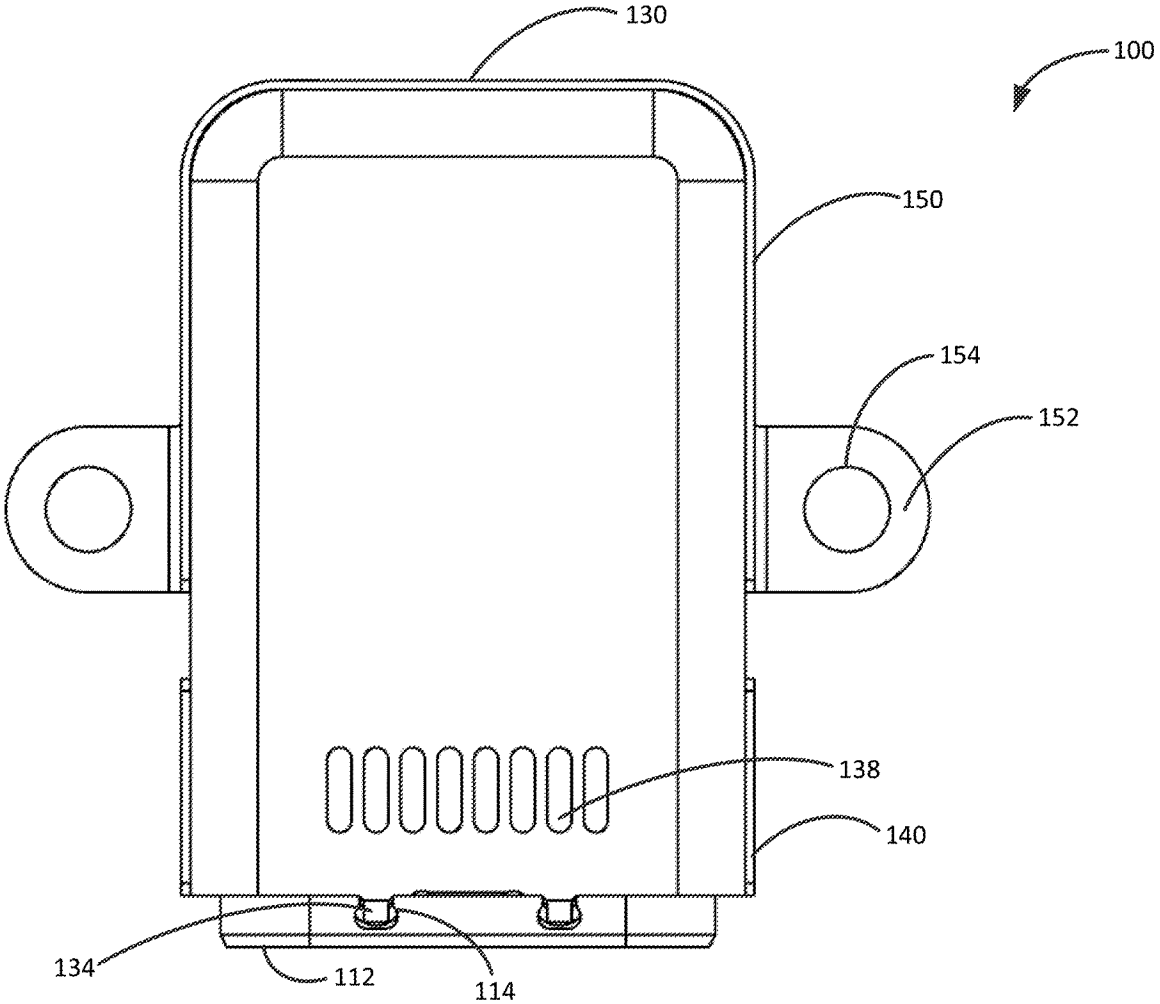
FIG. 5 illustrates a top view of the connector receptacle of FIG. 1.

FIG. 5 illustrates a top view of the connector receptacle of FIG. 1. Extensions 132 of top shield portion 130 may be folded into openings 114 in guide 112. Top shield portion 130 may include openings 138. Openings 138 may allow the deflection of contacts in connector receptacle 100 when a connector insert is inserted into connector receptacle 100. Connector receptacle 100 may further include a bottom shield portion 140. Second bottom shield portion 150 may include flanges 152 having fastener openings 154.

Figure 6:
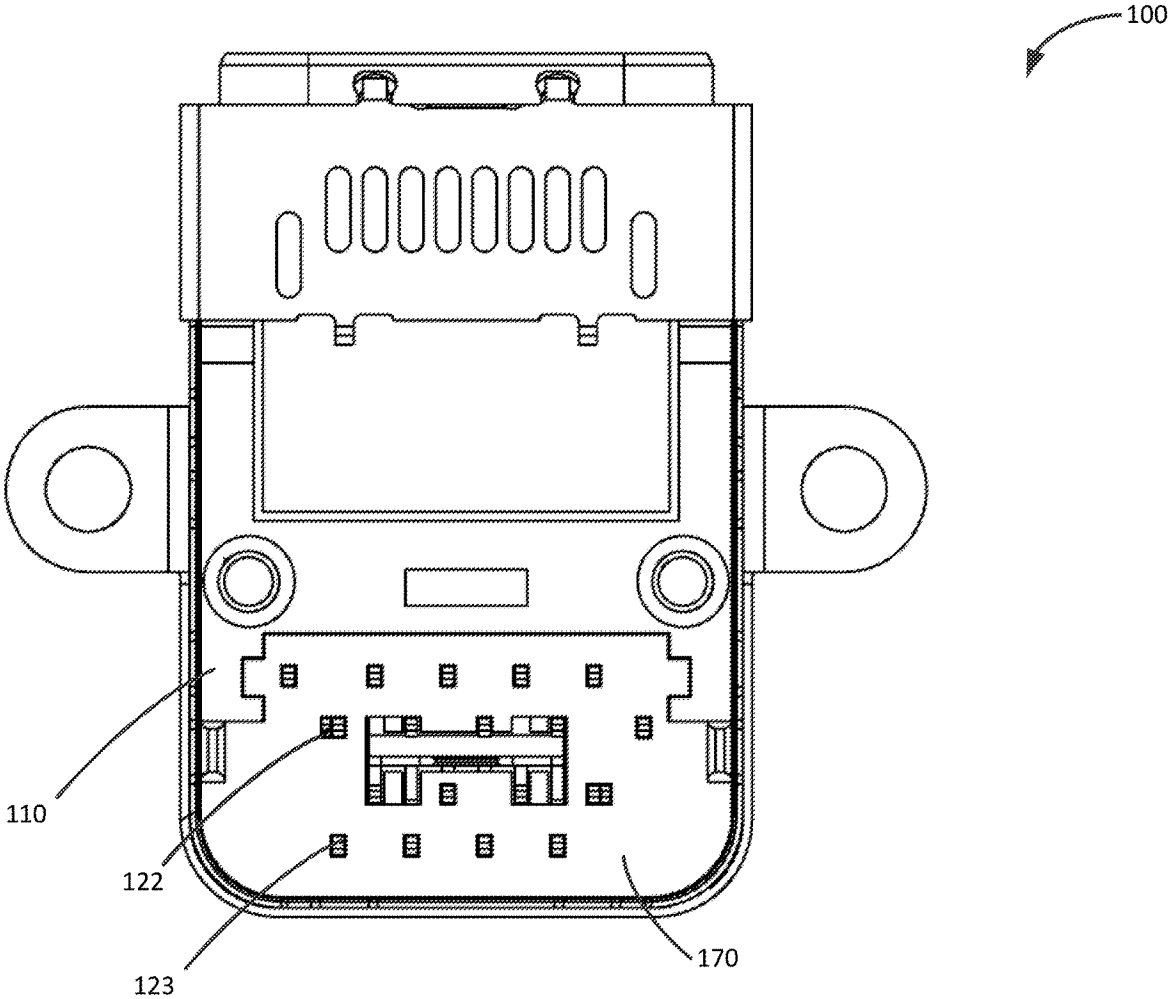
FIG. 6 illustrates a bottom view of the connector receptacle of FIG. 1.

FIG. 6 illustrates a bottom view of the connector receptacle of FIG. 1. Contact tails 122 for a bottom row of contacts and contact tails 123 for a top row of contacts may emerge from a bottom of rear housing portion 170. Rear housing portion 170 may interlock with front housing portion 110 to add strength to connector receptacle 100.

Figure 7:
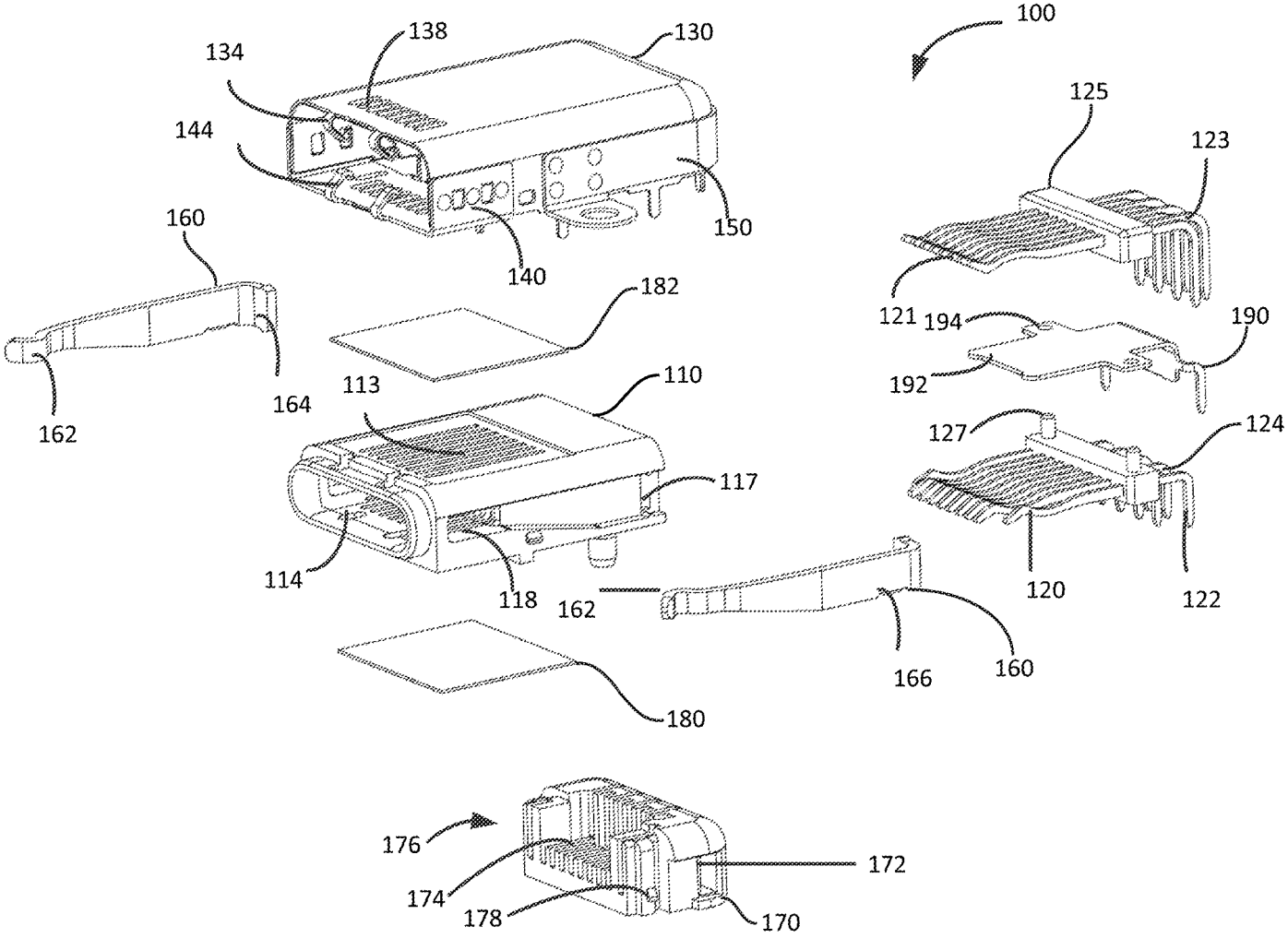
FIG. 7 illustrates an exploded view of the connector receptacle of FIG. 1.

FIG. 7 illustrates an exploded view of the connector receptacle of FIG. 1. Connector receptacle 100 may include a bottom row of contacts 120 joined by insert molded portion 124. Contacts 120 may have surface-mount or through-hole contacting tails. In this example, contacts 120 may have through-hole contacting tails 122. Insert molded portion 124 may include posts 127. Ground contact or ground plane 192 may include openings 194 to fit over posts 127. Ground plane 192 may have contacting tails 190. Connector receptacle 100 may also have a top row of contacts 120. Top row contacts 121 may be joined together with insertion molded piece 125. Insertion molded piece 125 may have an opening (not shown) on an underside to accept posts 127. Top row contacts 121 may have contact tails, which in this example may be through-hole contact tails 223. During assembly, the top row of contacts 121, ground plane 192, and bottom row contacts 120 may be joined together. This contact assembly may be joined with rear housing piece 170. Specifically, contact tails 123, 190, and 32 may be fit into passages 174 in rear housing piece 170. Insert molded portions 124 and 125 may be located in notch 176 in rear housing piece 170.

The beam portions of contacts 121 and 120 may be fit into the front housing portion 110. Rear housing portion 170 may be fixed to housing portion 110 by mating tabs 178 in rear housing portion 170 with openings 117 in housing 110.

Side ground contacts 160 may be attached to the assembled housing. Specifically, tabs 164 on ground contacts 160 may be inserted into openings 172 on sides of rear housing portion 170. Side ground contacting portions 162 may be made available at openings 118 in sides of housing 110. During assembly, a carrier may be attached at point 166 on side ground contact 160. Once tab 164 is inserted into opening 172 in rear housing portion 170, the carrier may be detached from point 166.

Front housing portion 110 may include grooves or slots 113 on a top and bottom side. Grooves or slot 113 may allow for the deflection of contacts 121 and 120 during the insertion of a connector insert. To prevent contacts 121 and 120 from contacting top shell portion 130, protective layers 180 and 182 may be used. These protective layers may be placed over slots or grooves 113. Protective layers 182 may have an insulating side facing slots or grooves 113 to prevent electrical connections between pins. Protective layers 180 and 182 may have a metallic foil layer to prevent high frequency leakage through openings 138 in top shield portion 130.

Top shield portion 130 may be placed over housing 110. Contacts 134 may be aligned with openings 114 in housing 110. A first bottom shield portion 140 may be attached to top shield portion 130. Contacts 144 may be aligned with openings 114 in housing 110. A second bottom shield portion 150 may also be attached to top shield portion 130. These shield portions may be fixed together using spots or laser welding.

Figure 8:
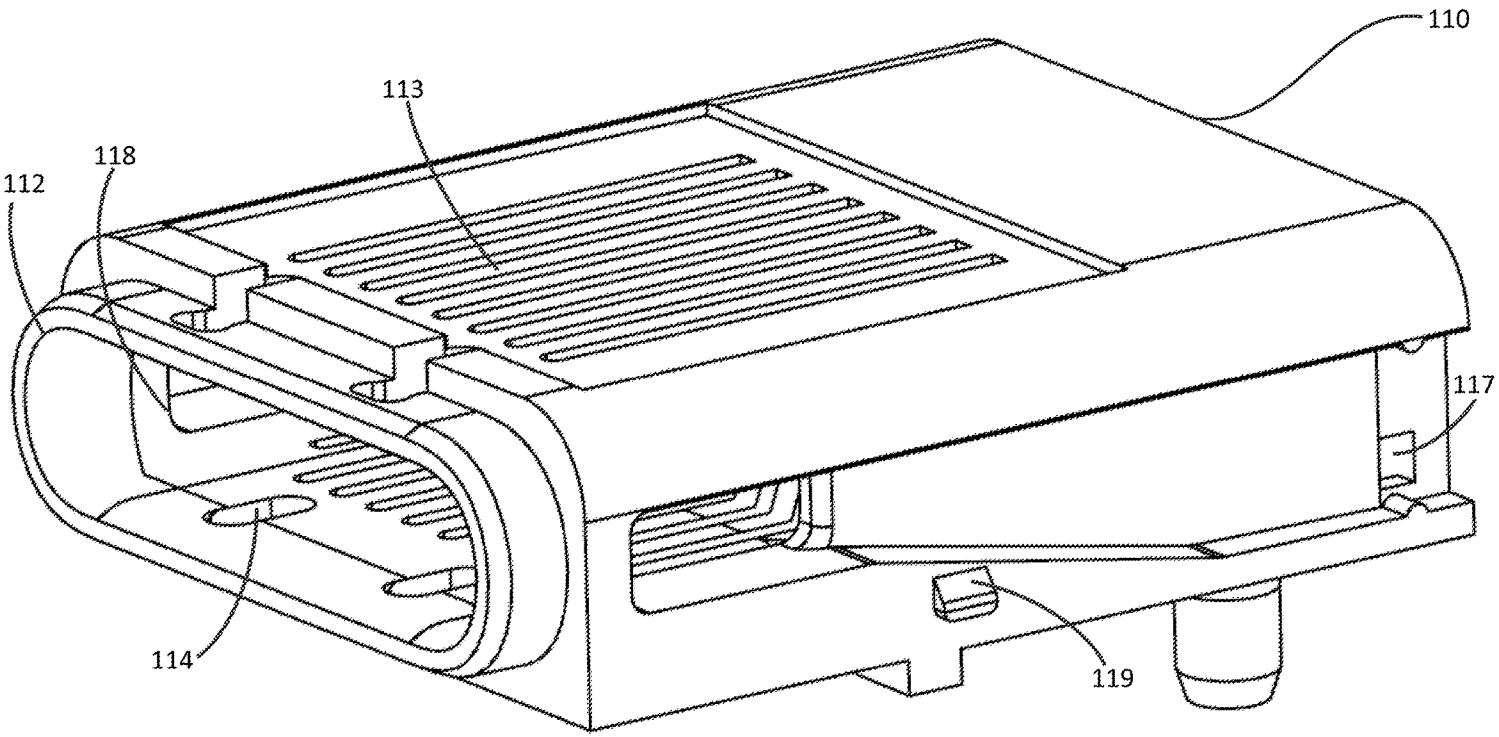
FIG. 8 illustrates a housing that may be used as the housing in the connector receptacle of FIG. 1.

FIG. 8 illustrates a housing that may be used as the housing in the connector receptacle of FIG. 1. Housing 110 may include a front guide 112. The front guide 112 may have openings 114 for accepting ground contacts formed by extensions of a shield. Side openings 118 may expose contacting portions of side ground contacts. Slots 113 may be used to house contacts. Slots 113 may allow the contacts to deflect when a connector insert is inserted into the connector receptacle. Tab 119 may be used to accept an opening on a top shield portion to secure a top shield portion to housing 110. Opening 117 may accept a tab on a rear housing portion in order to lock housing 110 and a rear housing portion together.

Figure 9:
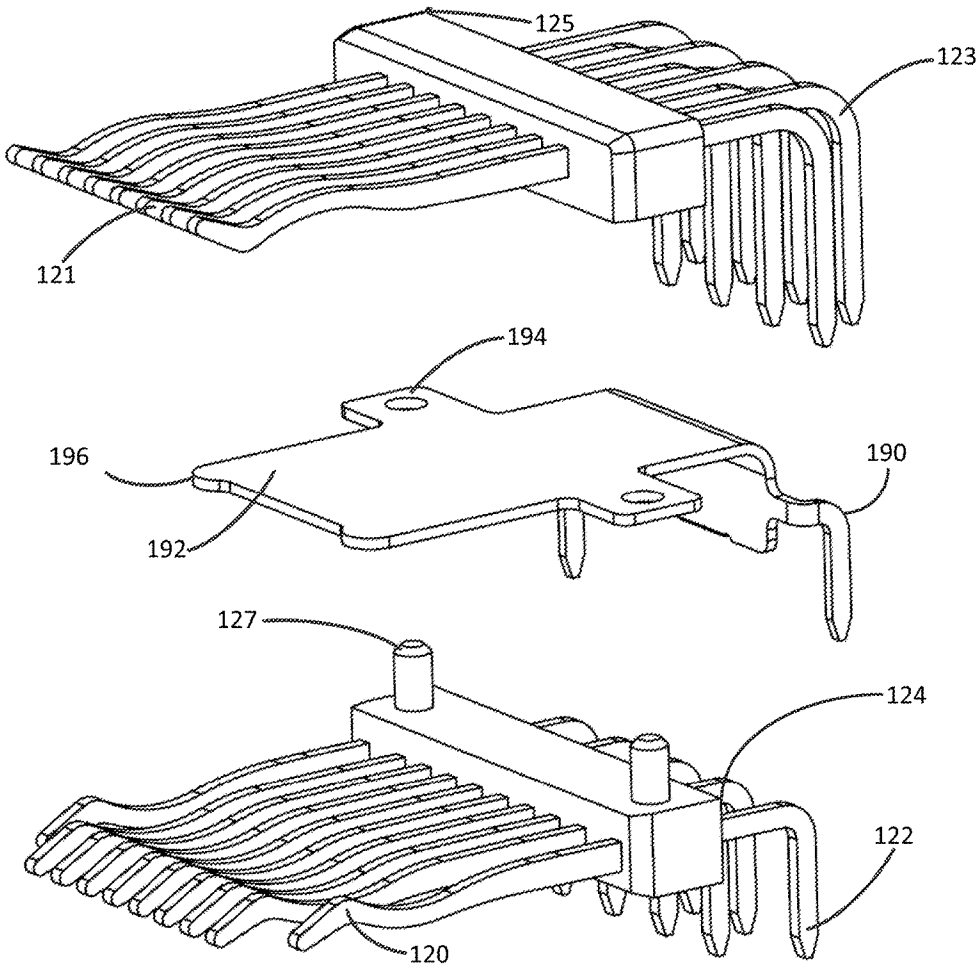
FIG. 9 illustrates a contact assembly that may be used as a contact assembly in the connector receptacle of FIG. 1.

FIG. 9 illustrates a contact assembly that may be used as a contact assembly in the connector receptacle of FIG. 1. A bottom row of contacts 120 may be joined by insert molded piece 124. Contacts 120 may have contact tails 122. Outside contacts in the bottom row of contacts 120 may be used as detect pins. Insert molded housing 124 may include posts 127. Posts 127 may accept openings 194 of ground plane 192. Ground plane 192 may include contact tails 190 and contacts 296. A top row of contacts 121 may be joined by insert molded piece 125. Insert piece 125 may have openings on an underside to accept posts 127. Contacts 121 may include contact tails 123. The joined insert molded pieces 124 and 125 may fit in a notch in a rear housing portion.

Figure 10:
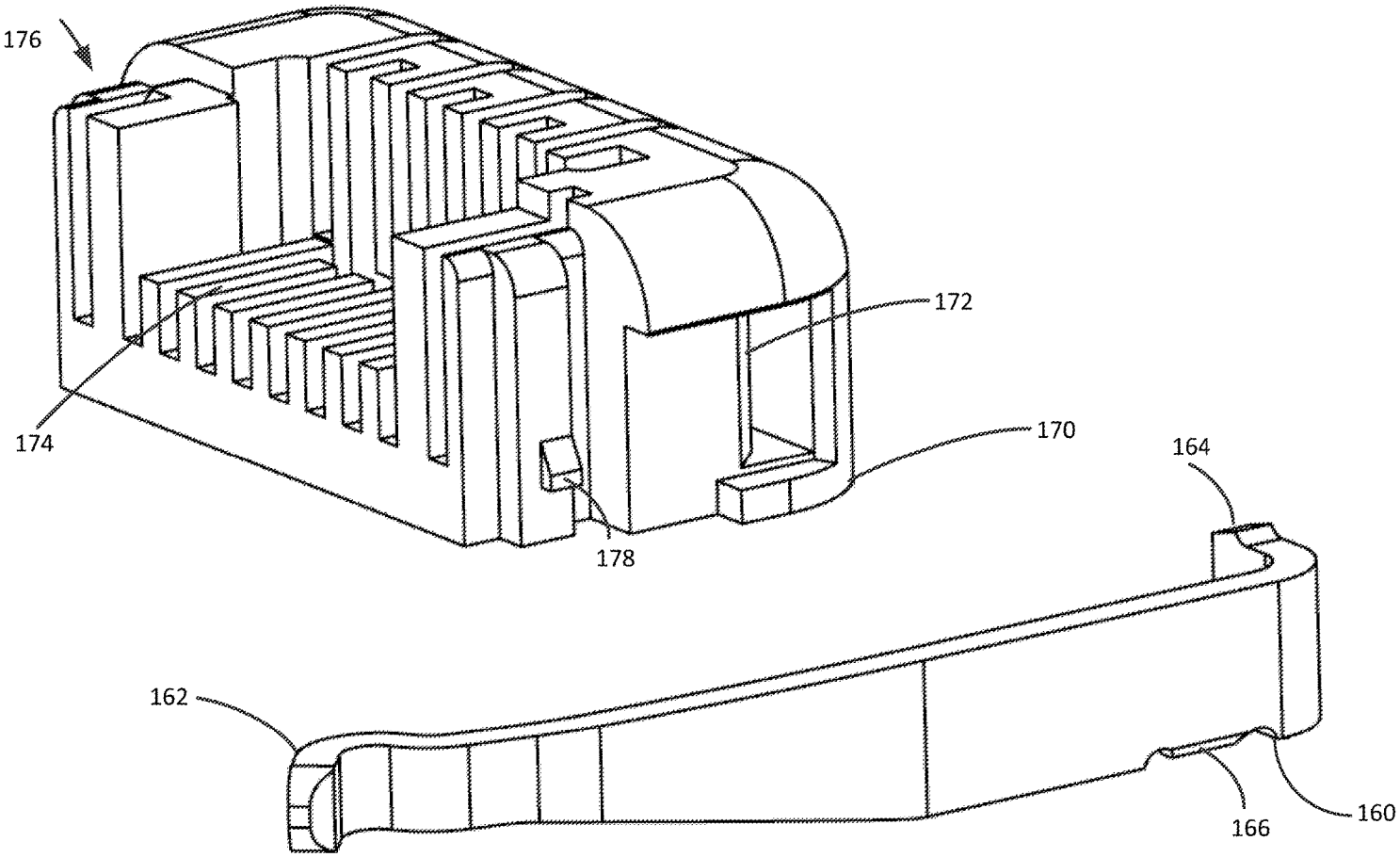
FIG. 10 illustrates a rear housing portion and side ground contacts that may be used as a rear housing portion and side ground contacts in the connector receptacle of FIG. 1.

FIG. 10 illustrates a rear housing portion and side ground contacts that may be used as a rear housing portion and side ground contacts in the connector receptacle of FIG. 1. Rear housing portion 170 may include passages 174 for accepting contact tails of contacts in the receptacle. Notch 176 may accept insert molded portions around those contacts. Tab 178 may fit in an opening in a front housing portion to secure rear housing portion 170 to the front housing portion. Opening 172 may accept tab 164 on side ground contacts 160. Contacting portions 162 of side ground contact 160 may be available at an opening of the front housing portion. A carrier may be attached to side ground contact 160 at point 166. When tab 164 is inserted into opening 172, the carrier may be removed from point 166.

Figure 11:
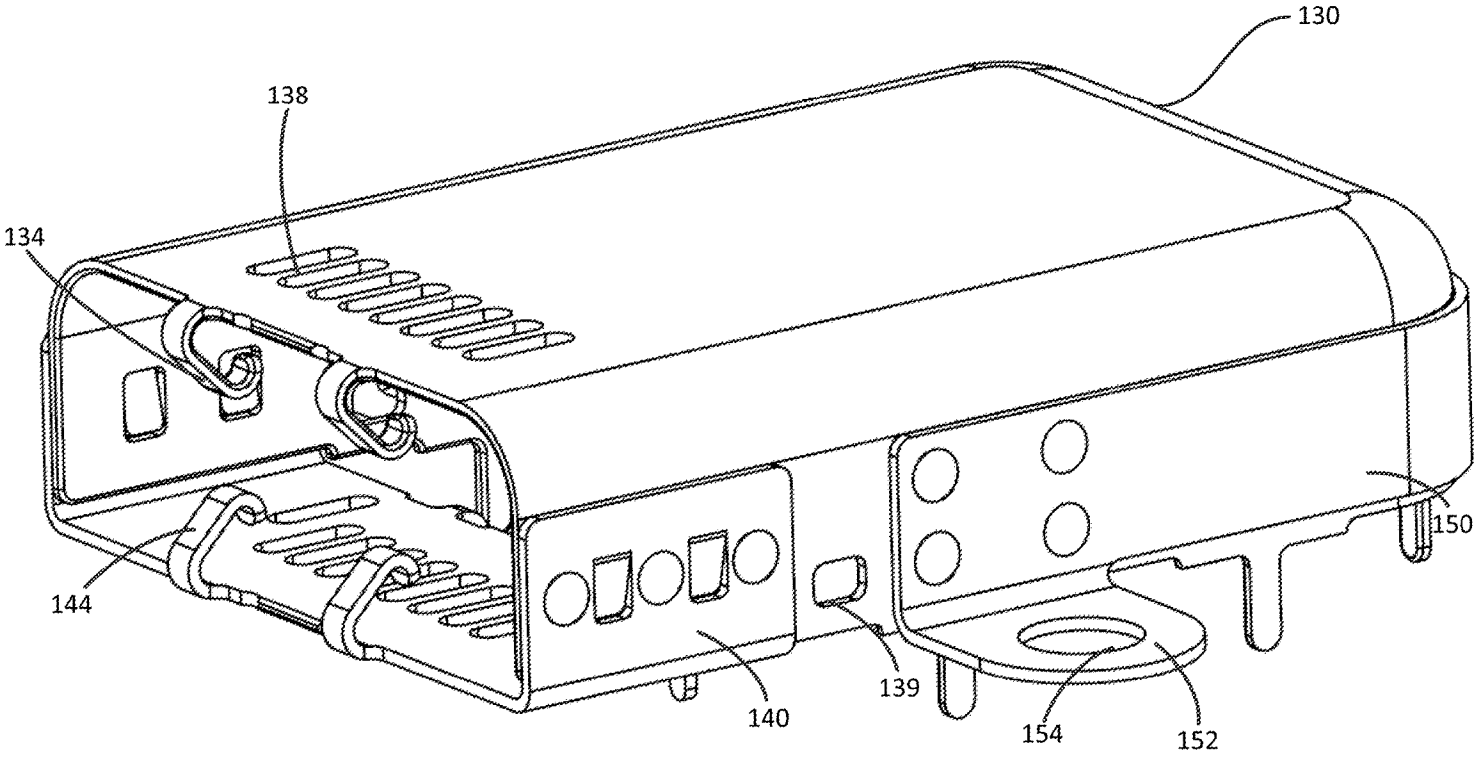
FIG. 11 illustrates top and bottom shield portions that may be used as the top and bottom shield portions for the connector receptacle of FIG. 1.

FIG. 11 illustrates top and bottom shield portions that may be used as the top and bottom shield portions for the connector receptacle of FIG. 1. A top shield portion 130 may include openings 138 and extensions forming contacts 134. Opening 139 in top shield portion 130 may accept a tab on a housing to secure top shield portion 130 to the housing. First bottom shield portion 140 may include ground contacts 144. Second bottom shield portion 150 may include flanges 152 having fastener openings 154.

In other embodiments of the present invention, a connector receptacle may be attached to a device in other ways and flanges 152 may not be needed. An example is shown in the following figure.

Figure 12:
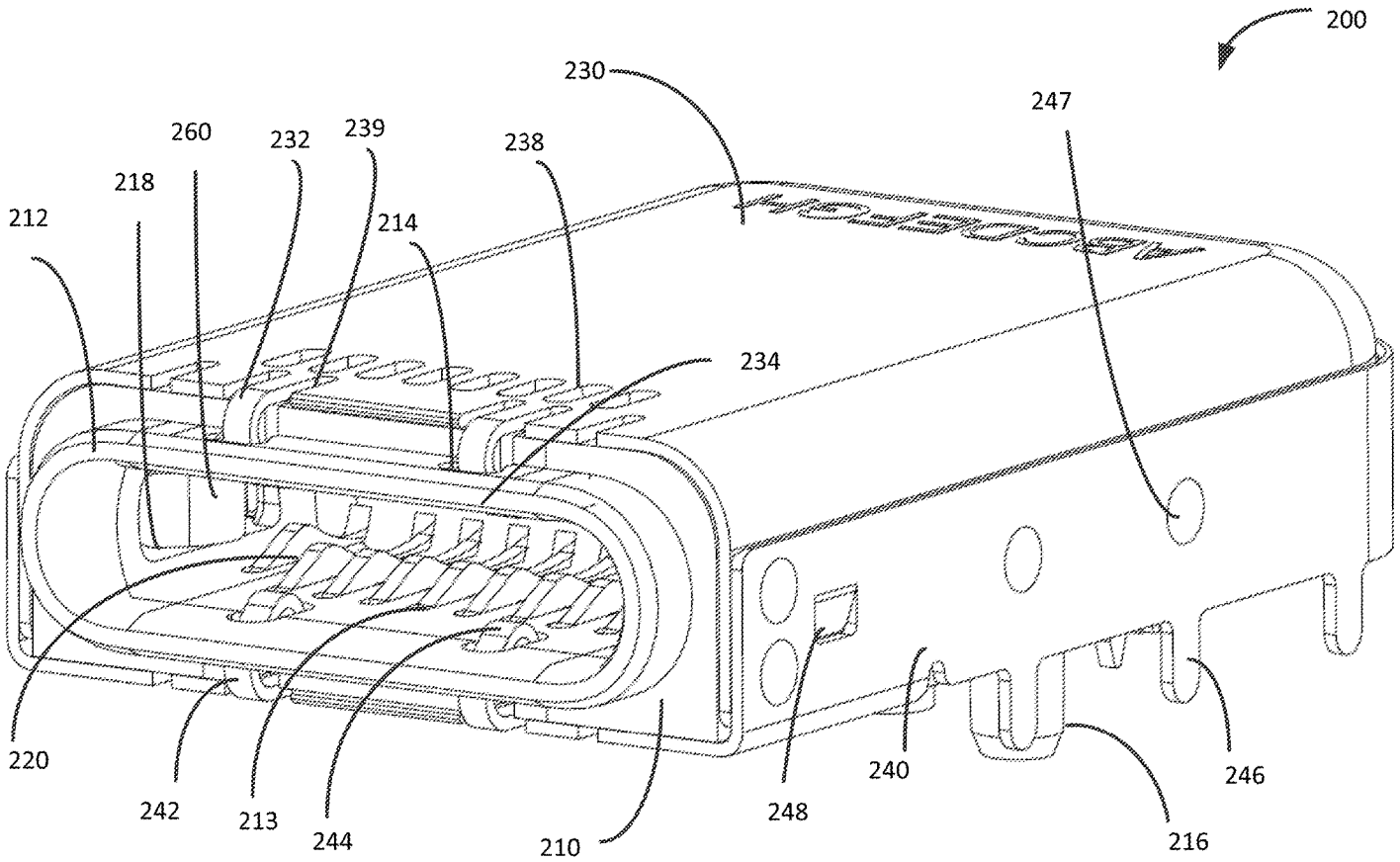
FIG. 12 illustrates another connector receptacle according to an embodiment of the present invention.

FIG. 12 illustrates another connector receptacle according to an embodiment of the present invention. Connector receptacle 200 may include housing 210 having a front guide 212 forming a front opening. As before, a connector insert may be inserted into the connector receptacle via the opening in front guide 212. A number of contacts 220 may be located in slots or passages 213 in housing 210. Side ground contacts 260 may be exposed at side openings 218 in housing 210. Side ground contacts 160 may provide a retention force when a connector insert is inserted into this connector receptacle. This retention force may be increased by reinforcement provided by the shield portions described below. Housing 210 may include posts 216. Posts 216 may be placed in openings of a printed circuit board, device enclosure, or other appropriate substrate for mechanical stability.

Connector receptacle 200 may be at least partially covered on a top side by top shell or top shield portion 230. Extensions 232 may extend from a front of top shield portion 230. Extensions 232 may be folded over and passed through openings 214 in front guide 212 to form contacts 234. To reduce fatigue in the metal of extensions 232, slots 239 may be formed on either side of extensions 232. Contacts 234 may be ground contacts to form an electrical connection with a ground path or ground ring on a connector insert. Shield portion 230 may also include openings 238. Openings 238 may provide room for the deflection of contacts 220 when a connector insert is inserted into the connector receptacle 200. When top shield portion 230 is fitted over housing 210, an opening (not shown) on top shield portion 230 may accept a tab (not shown) on housing 210. Similar tabs may be located on an opposing side and rear of connector receptacle 200. These tabs and openings may hold top shield portion 230 in place relative to housing 210.

Connector receptacle 200 may include a bottom shield portion 240. Bottom shield portion 240 may include tabs 248 that may fit in openings (not shown) in top shield portion in order to secure bottom shield portion 240 to top shield portion 230. Similar to top shield portion 230, bottom shield portion 240 may include extensions 242. Extensions 242 may be passed through openings 214 in front guide portion 212 to form contacts 244. Contacts 244 may be ground contacts to form a ground connection with a ground pad or ground ring on a connector insert. Bottom shield portion 240 may be fixed to top shield portion 230 by spot or laser welding at points 247. Bottom shield portion 240 may further include tabs 246. Tabs 246 may be inserted into openings and connected to ground pads or traces in a printed circuit board or other appropriate substrate in an electronic device housing connector receptacle 200. Bottom shield portion 240 may include openings similar to openings 238.

In this and the other embodiments of the present invention, one or more of these shield portions may be formed using a deep drawn process. This deep drawn process may result in a heavy duty shield portion having fewer openings as opposed to a conventional stamping, folding, and bending process.

Again, signals conveyed on contacts 220 may have a high data rates. Also, a relatively large number of signals may be packed into a fairly small connector receptacle 200. Accordingly, this and the other embodiments of the present invention may utilize various techniques for improving grounding. For example, ground contacts 234 and 244 may be included to electrically connect to ground pads or a ground ring on a connector insert. Side ground contacts 260 may also be provided. Side ground contacts 260 may form ground connections with ground pads or a ground ring at the sides of a connector insert. Again, shield portions 230 and 240 may be deep drawn to reduce openings and sharp angles. These ground portions may be interlocked using openings and tabs and attached using spot or laser welding as well. As will be seen below, foil layers may be used to prevent high frequency leakage through openings 238. Also, a mid-opening ground plane may be located in the front opening of connector receptacle 200. Side ground contacts 260 may provide a retention force that pulls a connector insert into contact with the mid-opening ground plane. This retention force may be increased by the reinforcement provided by the shield portions 230 and 240. Further, contacts 220 may be used to convey differential signals. Typically, the differential signals may be located on adjacent contacts or pins. Contacts for AC signal grounds may be placed on each side of these adjacent contacts or pins. These AC grounds may include ground, power supplies, control lines, and other path having a low impedance to ground.

To further improve the signal integrity and quality, contacts 220 may be formed using a low impedance material. For example, an alloy of copper-nickel-silicon may be used. The resulting contacts 220 may have a lower impedance but may have a reduced beam spring force. Accordingly, embodiments of the present invention may compensate for this by using slightly longer contacts 220 than may otherwise be used. These longer contacts may have stronger beam force while maintaining a lower contact resistance.

Figure 13:
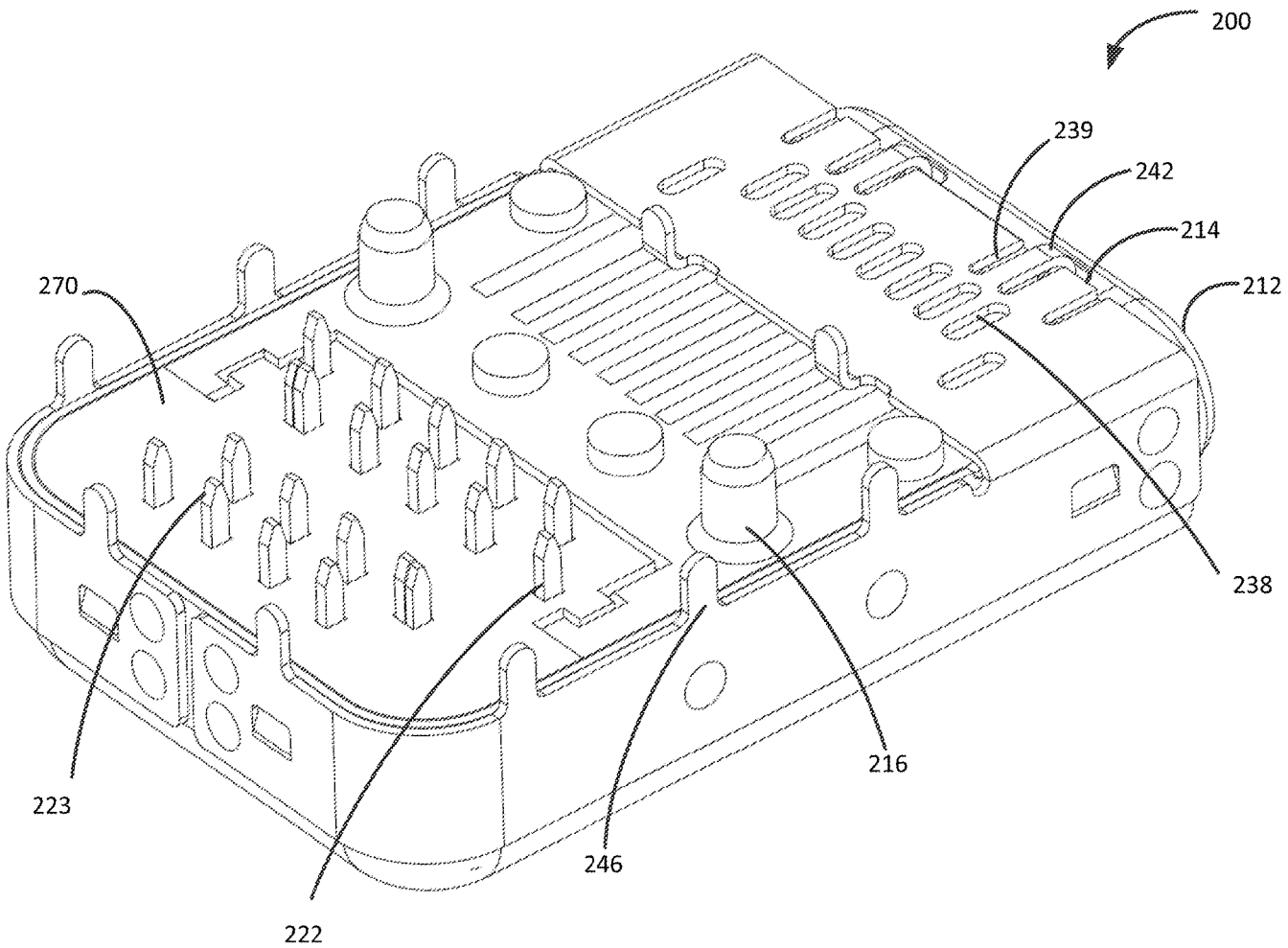
FIG. 13 illustrates an oblique bottom side view of the connector receptacle of FIG. 12.

FIG. 13 illustrates an oblique bottom side view of the connector receptacle of FIG. 12. Contact tails 222 for a bottom row of contacts 220 and contact tails 223 for a top row of contacts may emerge from an underside of a rear housing portion 270. Contact tails 222 and 223 may be through-hole contact tails which may be inserted into openings in a printed circuit board or other appropriate substrate. In other embodiments of the present invention, other types of contacts, such as surface mount contacts, may be used.

A top shield portion 230 may be attached to bottom shield portion 240. Bottom shield portion 240 may include openings 238, which may be similar to openings 238 on a top side of connector receptacle 200. Extensions 242 may extend from bottom shield 240 and may pass through opening 214 in front guide 212 to form ground contacts is shown above. Slots 239 may be located on each side of extensions 242 in order to reduce fatigue on extensions 242 by increasing their beam length. Posts 216 and tabs 246 may also emerge from a bottom of connector receptacle 200. Posts 216 may be placed in openings in a printed circuit board or other substrate for mechanical stability. Tabs 246 may be placed in openings connected to ground traces or planes in a printed circuit board or other substrate.

Figure 14:
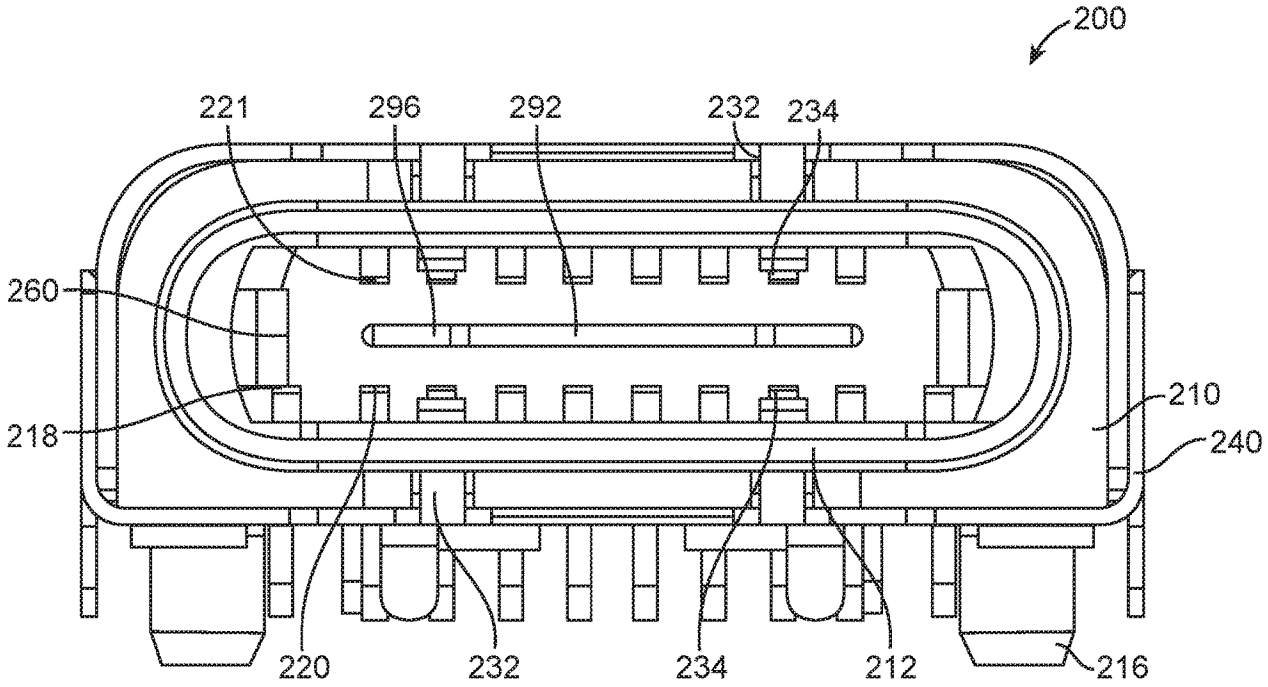
FIG. 14 illustrates a front view of the connector receptacle of FIG. 12.

FIG. 14 illustrates a front view of the connector receptacle of FIG. 12. Housing 210 may have an opening in a front guide 212 into which a connector insert may be inserted. Connector receptacle 200 may include a top row of contacts 221 and a bottom row of contacts 220. Extensions 232 and 242 may be inserted through openings in front guide 212 and folded back to form ground contacts 234 and 244. Side ground contacts 260 may be available at side openings 218 in housing 210.

A center ground plane or ground contact 292 may also be included. The center ground plane or ground contact may form a ground connection with a pad or ground ring on a front of a connector insert when the connector insert is inserted into connector receptacle 200. Ground plane or ground contact 292 may include ground contacts 296. These ground contacts 296 on the sides of ground plane 292 may help to maintain a ground connection when a connector insert is inserted into connector receptacle 200 at an angle. When a connector insert is inserted into connector receptacle 200, side ground contacts 260 may provide a force pulling the connector insert into connector receptacle 200. This may assist in maintaining a ground connection between ground contacts 296 on ground plane 292 and the ground pad or ground ring at the front of a connector insert. This force may be enhanced by the reinforcement provided by the various shield portions around housing 210.

Figure 15:
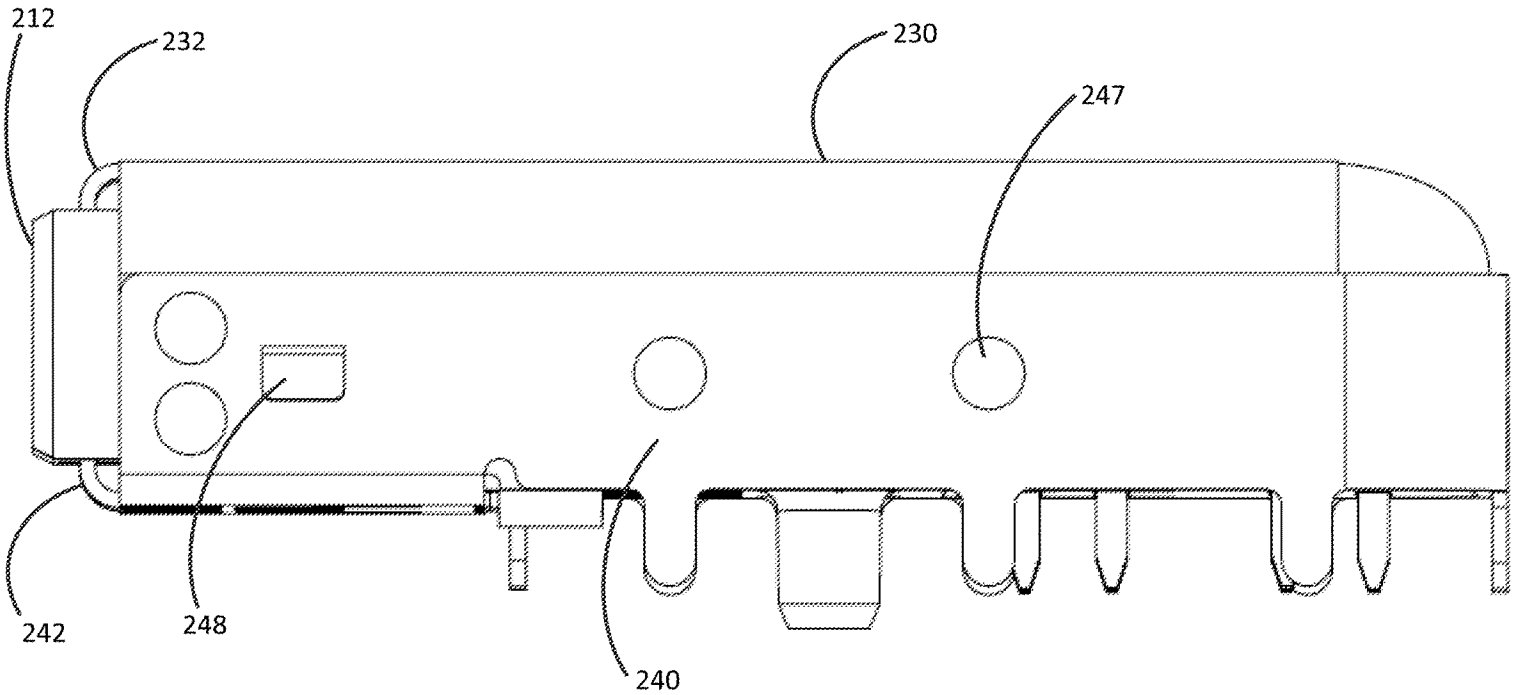
FIG. 15 illustrates a side view of the connector receptacle of FIG. 12.

FIG. 15 illustrates a side view of the connector receptacle of FIG. 12. Extensions 232 from top shield 230 may be folded into a front opening of connector receptacle 200. Similarly, extensions 242 of a bottom shield portion 240 may be folded into a front opening of connector receptacle 200. Bottom shield portion 240 may be attached to top shield portion 230 at points 247.

Figure 16:
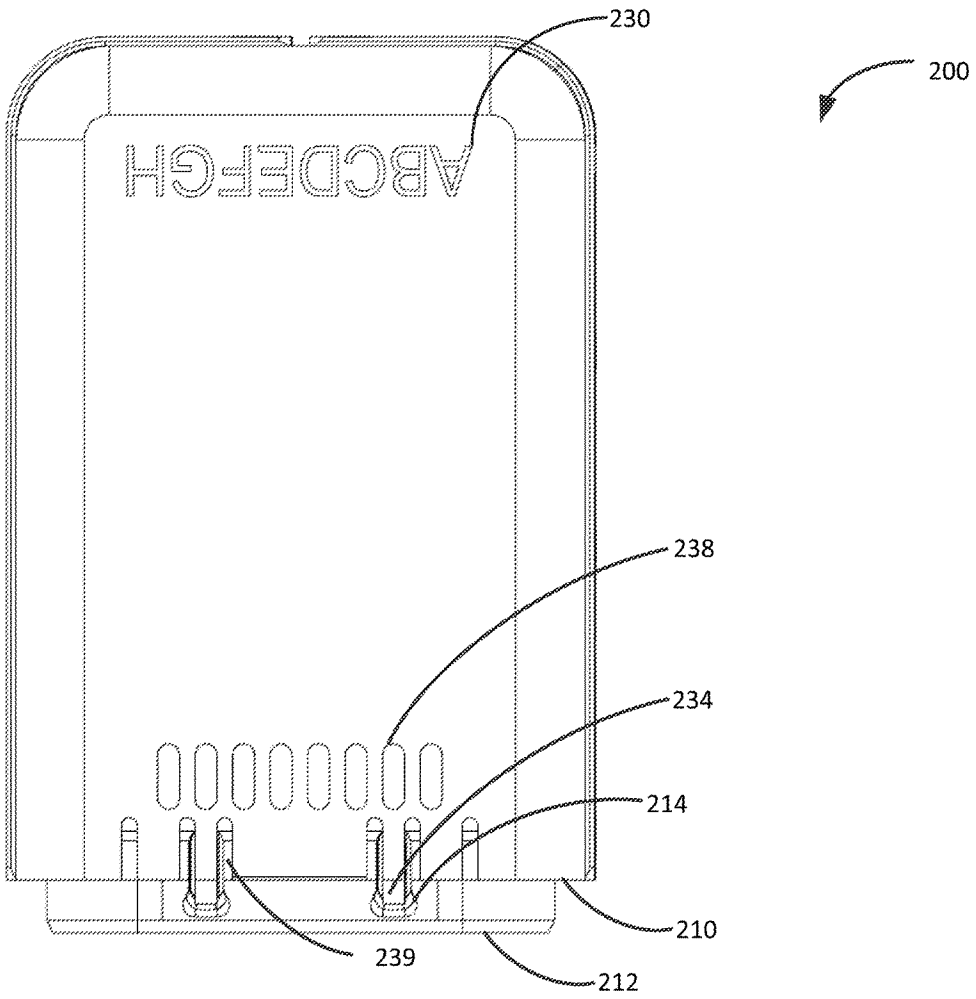
FIG. 16 illustrates a top view of the connector receptacle of FIG. 12.

FIG. 16 illustrates a top view of the connector receptacle of FIG. 12. Extensions 232 of top shield portion 230 may be folded into openings 214 in guide 212. Slots 239 may increase the flexibility of extensions 232. Top shield portion 230 may include openings 238. Openings 238 may allow the deflection of contacts in connector receptacle 200 when a connector insert is inserted into connector receptacle 200.

Figure 17:
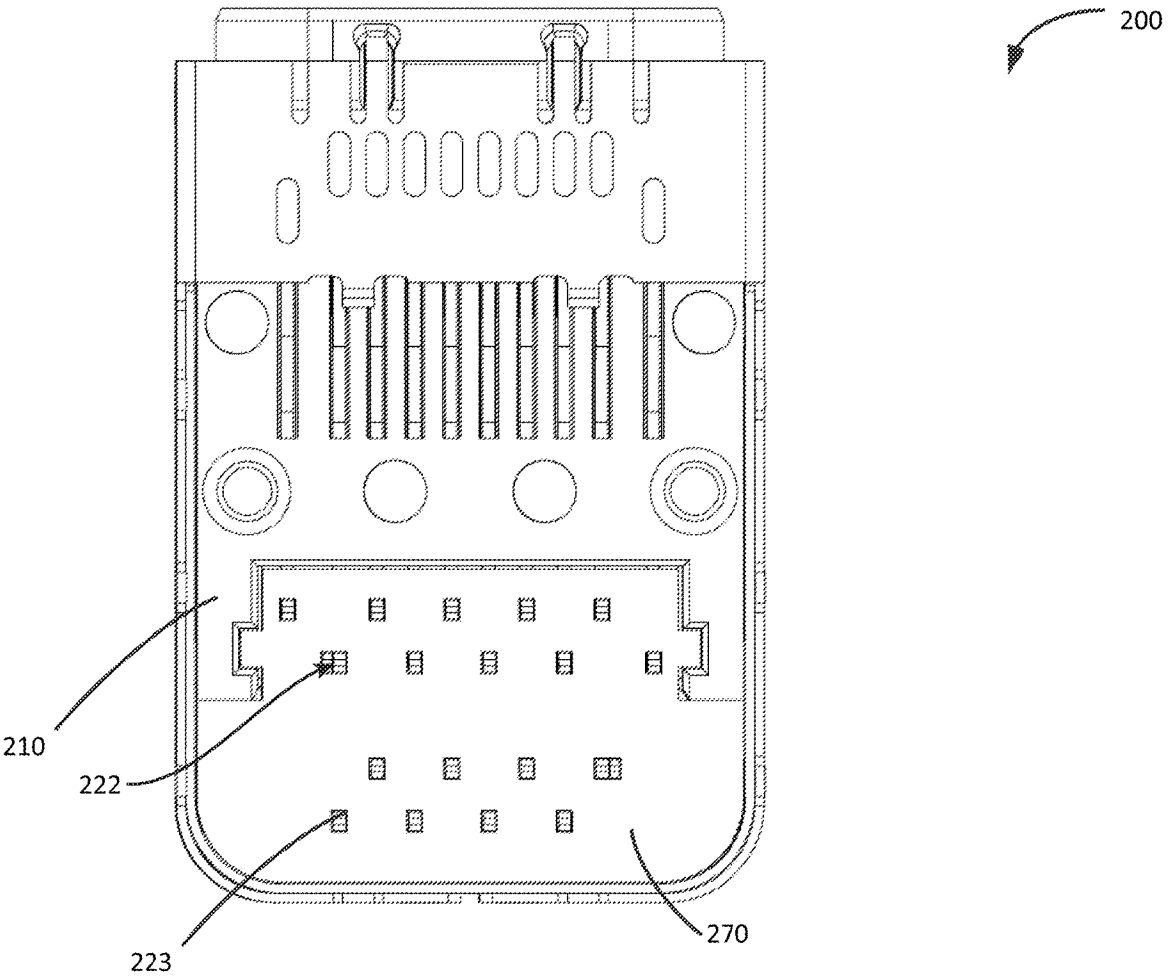
FIG. 17 illustrates a bottom view of the connector receptacle of FIG. 12.

FIG. 17 illustrates a bottom view of the connector receptacle of FIG. 12. Contact tails 222 for a bottom row of contacts and contact tails 223 for a top row of contacts may emerge from a bottom of rear housing portion 270. Rear housing portion 270 may interlock with front housing portion 210 to add strength to connector receptacle 200.

Figure 18:
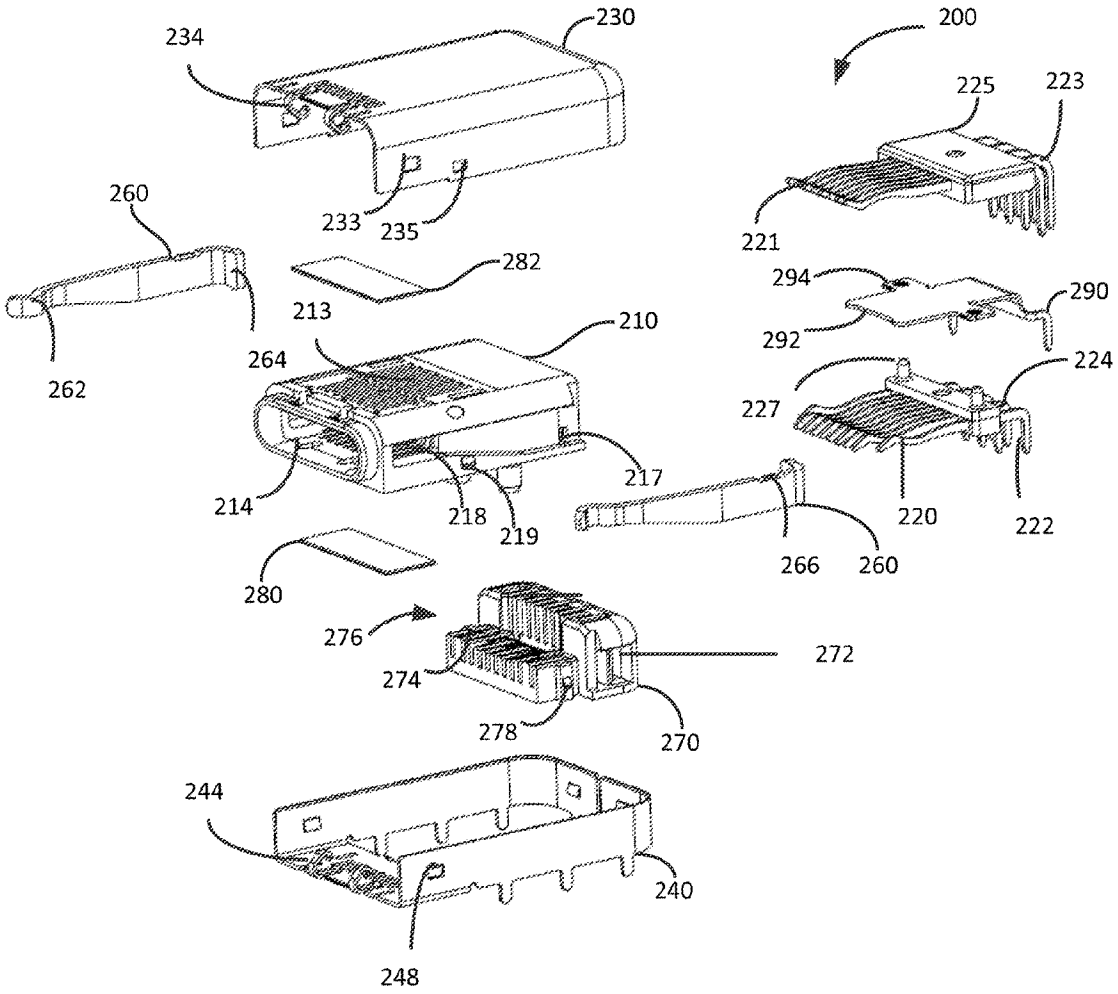
FIG. 18 illustrates an exploded view of the connector receptacle of FIG. 12.

FIG. 18 illustrates an exploded view of the connector receptacle of FIG. 12. Connector receptacle 200 may include a bottom row of contacts 220 joined by insert molded portion 224. Contacts 220 may have surface-mount or through-hole contacting tails. In this example, contacts 220 may have through-hole contacting tails 222. Insert molded portion 224 may include posts 227. Ground contact or ground plane 292 may include openings 294 to fit over posts 227. Ground plane 292 may have contacting tails 290. Connector receptacle 200 may also have a top row of contacts 220. Top row contacts 221 may be joined together with insertion molded piece 225. Insertion molded piece 225 may have an opening (not shown) on an underside to accept posts 227. Top row contacts 221 may have contact tails, which in this example may be through-hole contact tails 223. During assembly, the top row of contacts 221, ground plane 292, and bottom row contacts 220 may be joined together. This contact assembly may be joined with rear housing piece 270. Specifically, contact tails 222, 290, and 223 may be fit into passages 274 in rear housing piece 270. Insert molded portions 224 and 225 may be located in notch 276 in rear housing piece 270.

The beam portions of contacts 221 and 220 may be fit into front housing portion 210. Rear housing portion 270 may be fixed to housing portion 210 by mating tab 278 in rear housing portion 270 with opening 217 in housing 210.

Side ground contacts 260 may be attached to the assembled housing. Specifically, tabs 264 on ground contacts 260 may be inserted into openings 272 on sides of rear housing portion 270. Side ground contacting portions 262 may be made available at openings 218 in sides of front housing portion 210. During assembly, a carrier may be attached at point 266 on side ground contact 260. Once tab 264 is inserted into opening 272 in rear housing portion 270, the carrier may be detached from point 266.

Front housing portion 210 may include grooves or slots 213 on a top and bottom side. Grooves or slot 213 may allow for the deflection of contacts 220 and 221 during the insertion of a connector insert. To prevent contacts 221 and 220 from contacting top shell portion 230, protective layers 280 and 282 may be used. These protective layers may be placed over slots or grooves 213. Protective layers 282 may have an insulating side facing slots or grooves 213 to prevent electrical connections between pins. Protective layers 280 and 282 may have a metallic foil layer to prevent high frequency leakage through openings 238 in top shield portion 230 and corresponding openings in bottom shield portion 240.

Top shield portion 230 may be placed over housing 210. Contacts 234 may be aligned with openings 214 in housing 210. A first bottom shield portion 240 may be attached to top shield portion 230. Contacts 244 may be aligned with openings 214 in housing 210. The top and bottom shield portions 230 and 240 may be fixed together using spots or laser welding.

Figure 19:
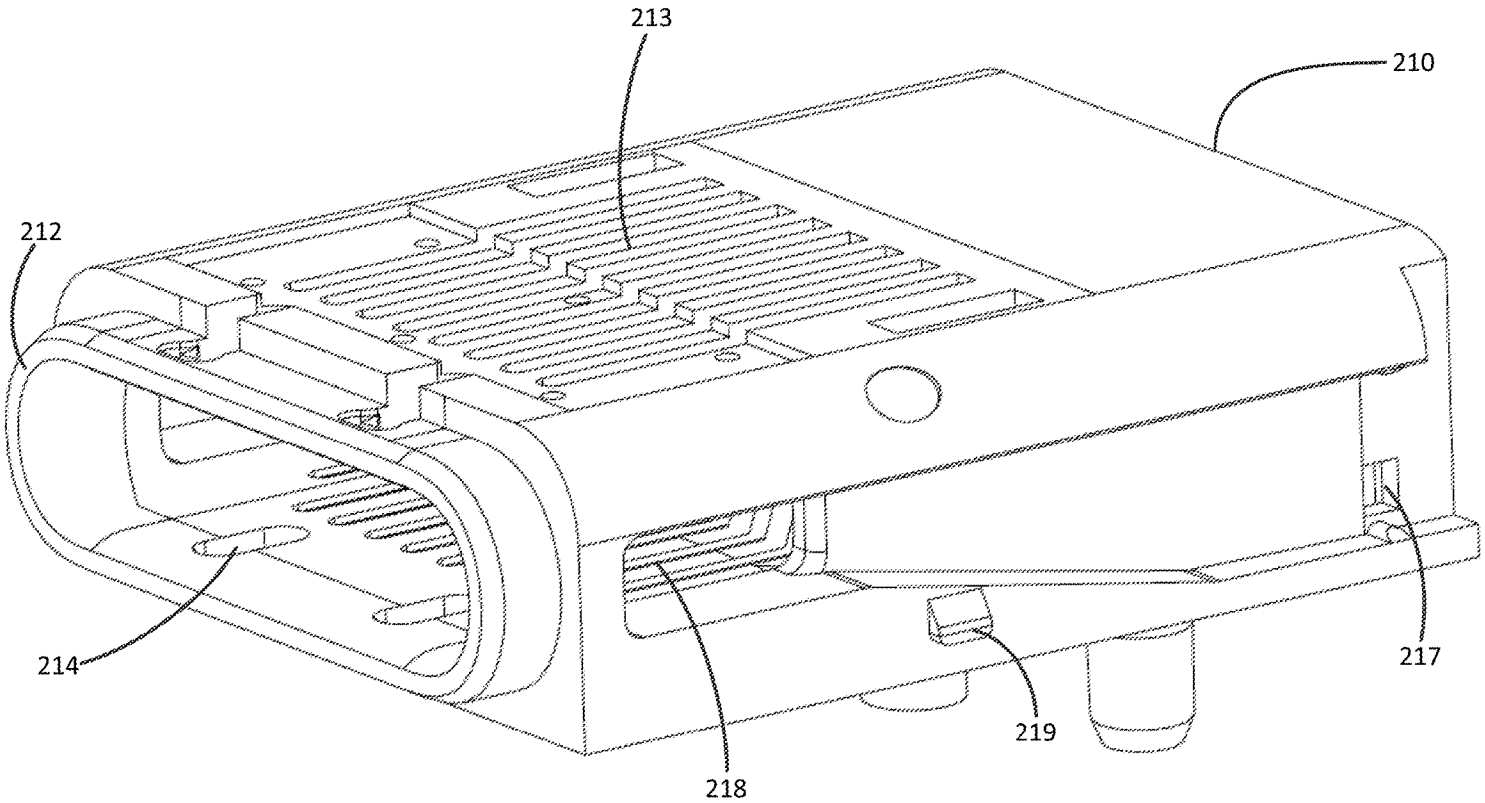
FIG. 19 illustrates a housing that may be used as the housing in the connector receptacle of FIG. 12.

FIG. 19 illustrates a housing that may be used as the housing in the connector receptacle of FIG. 12. Housing 210 may include a front guide 212. The front guide 212 may have openings 214 for accepting ground contacts formed by extensions of a shield. Side openings 218 may expose contacting portions of side ground contacts. Slots 213 may be used to house contacts. Slots 213 may allow the contacts to deflect when a connector insert is inserted into the connector receptacle. Tab 219 may be used to accept an opening on a top shield portion to secure a top shield portion to housing 210. Opening 217 may accept a tab on a rear housing portion in order to lock housing 210 and a rear housing portion together.

Figure 20:
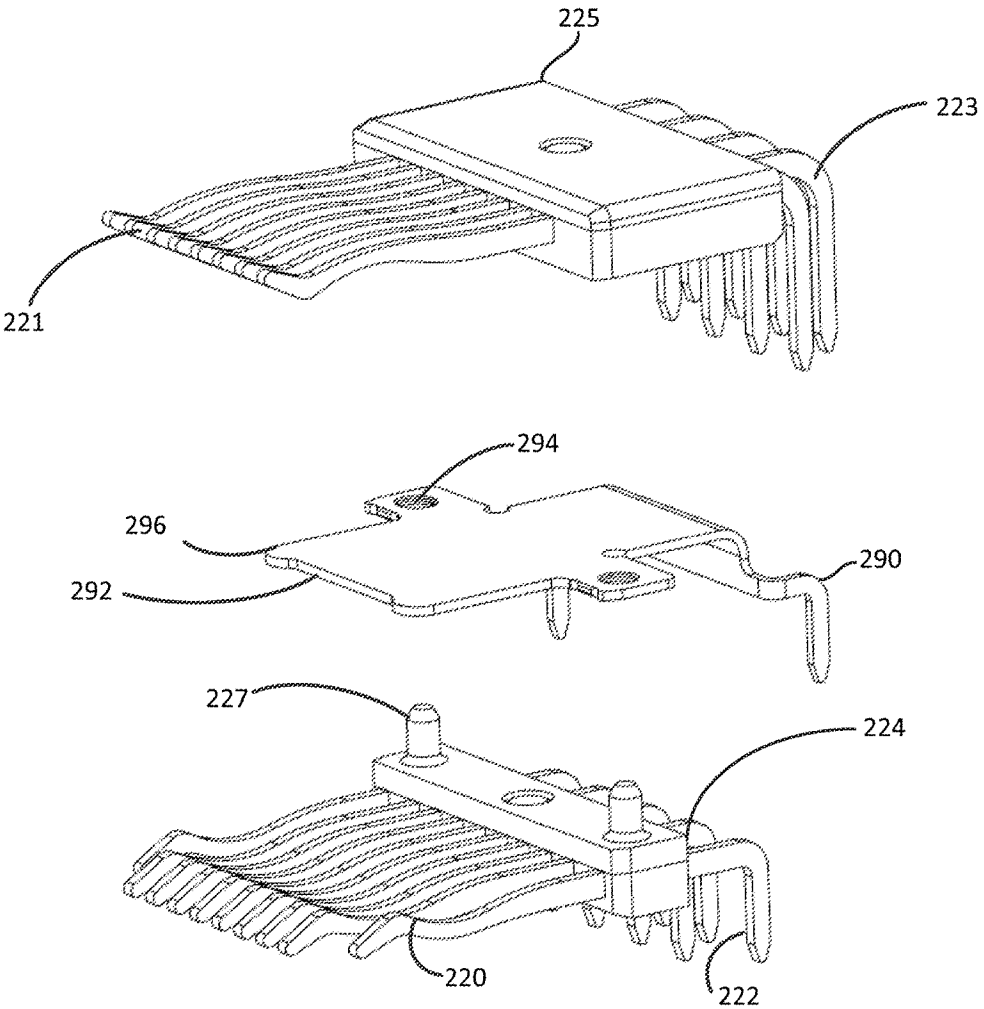
FIG. 20 illustrates a contact assembly that may be used as a contact assembly in the connector receptacle of FIG. 12.

FIG. 20 illustrates a contact assembly that may be used as a contact assembly in the connector receptacle of FIG. 12. A bottom row of contacts 220 may be joined by insert molded piece 224. Contacts 220 may have contact tails 222. Outside contacts in the bottom row of contacts 220 may be used as detect pins. Insert molded housing 224 may include posts 227. Posts 227 may accept openings 294 of ground plane 292. Ground plane 292 may include contact tails 290 and contacts 296. A top row of contacts 221 may be joined by insert molded piece 225. Insert piece 225 may have openings on an underside to accept posts 227. Contacts 221 may include contact tails 223. The joined insert molded pieces 224 and 225 may fit in a notch in a rear housing portion.

Figure 21:
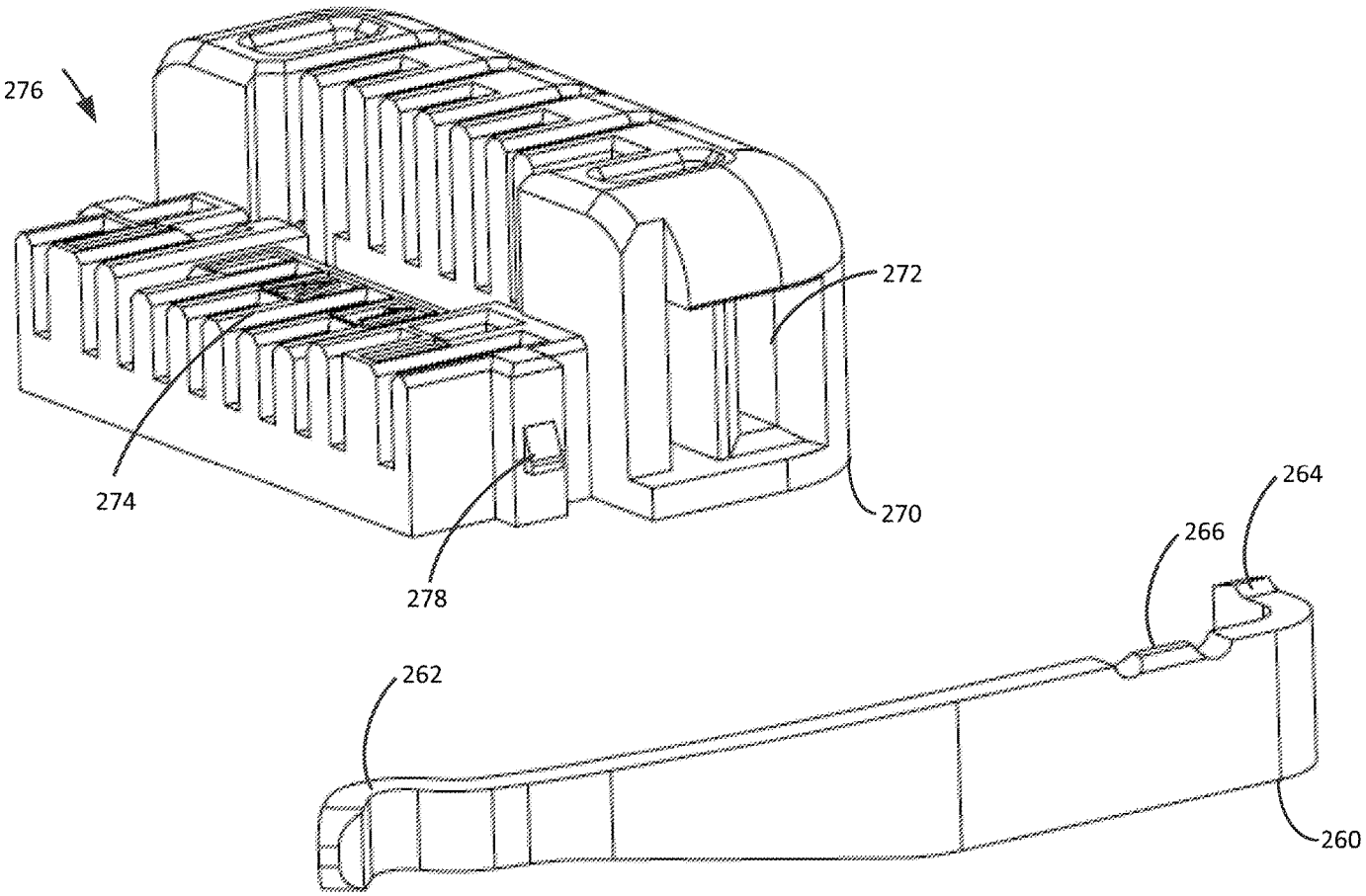
FIG. 21 illustrates a rear housing portion and side ground contacts that may be used as a rear housing portion and side ground contacts in the connector receptacle of FIG. 12.

FIG. 21 illustrates a rear housing portion and side ground contacts that may be used as a rear housing portion and side ground contacts in the connector receptacle of FIG. 12. Rear housing portion 270 may include passages 274 for accepting contact tails of contacts in the receptacle. Notch 276 may accept insert molded portions around those contacts. Tab 278 may fit in an opening in a front housing portion to secure rear housing portion 270 to the front housing portion. Opening 272 may accept tab 264 on side ground contacts 260. Contacting portions 262 of side ground contact 260 may be available at an opening of the front housing portion. A carrier may be attached to side ground contact 260 at point 266. When tab 264 is inserted into opening 272, the carrier may be removed from point 266.

Figure 22:
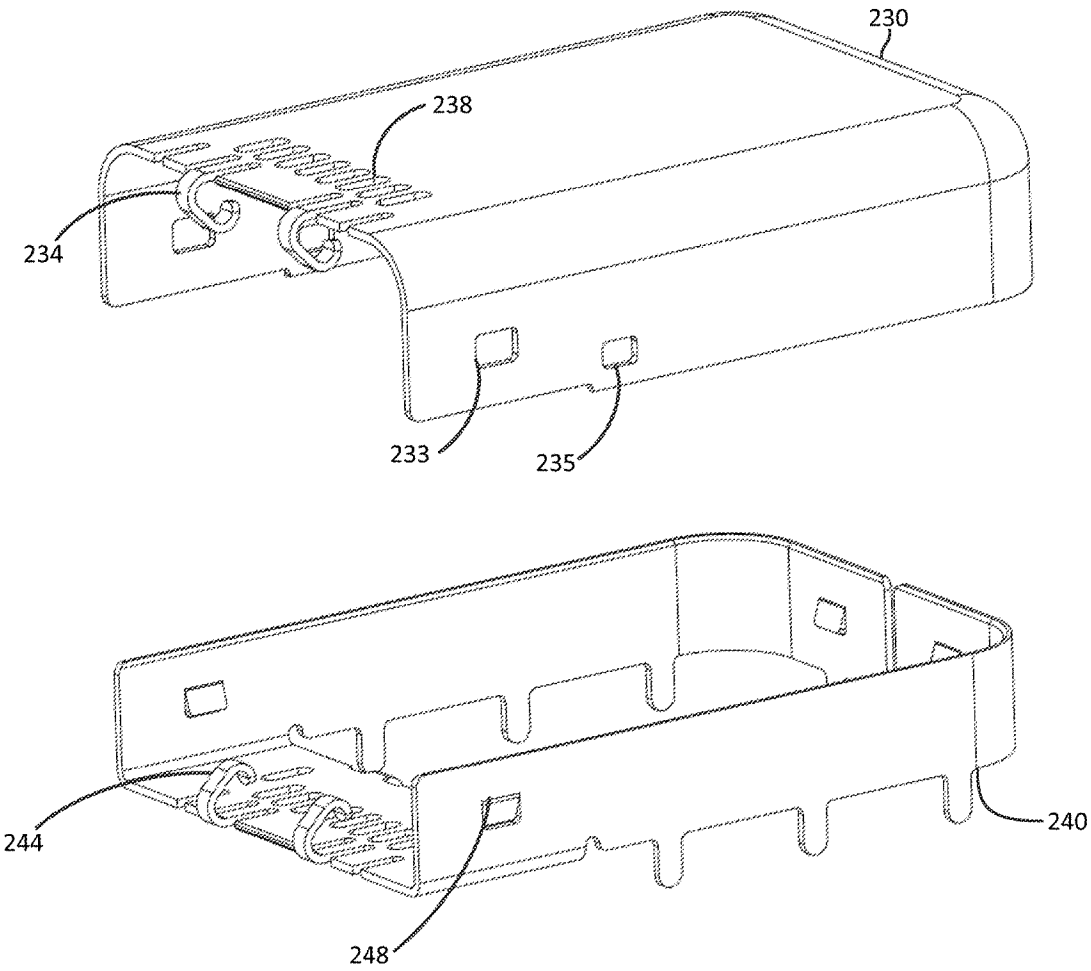
FIG. 22 illustrates top and bottom shield portions that may be used as the top and bottom shield portions for the connector receptacle of FIG. 12.

FIG. 22 illustrates top and bottom shield portions that may be used as the top and bottom shield portions for the connector receptacle of FIG. 12. A top shield portion 230 may include openings 238 and extensions forming contacts 234. Opening 239 in top shield portion 230 may accept a tab on a housing to secure top shield portion 230 to the housing. First bottom shield portion 240 may include ground contacts 244. Second bottom shield portion 250 may include flanges 252 having fastener openings 254.

In these examples, a connector receptacle may be mounted flat on a printed circuit board or other substrate. In other embodiments of the present invention, a connector receptacle may be attached to a printed circuit board in other ways. For example, the mounting may be vertical. An example is shown in the following figure.

Figure 23:
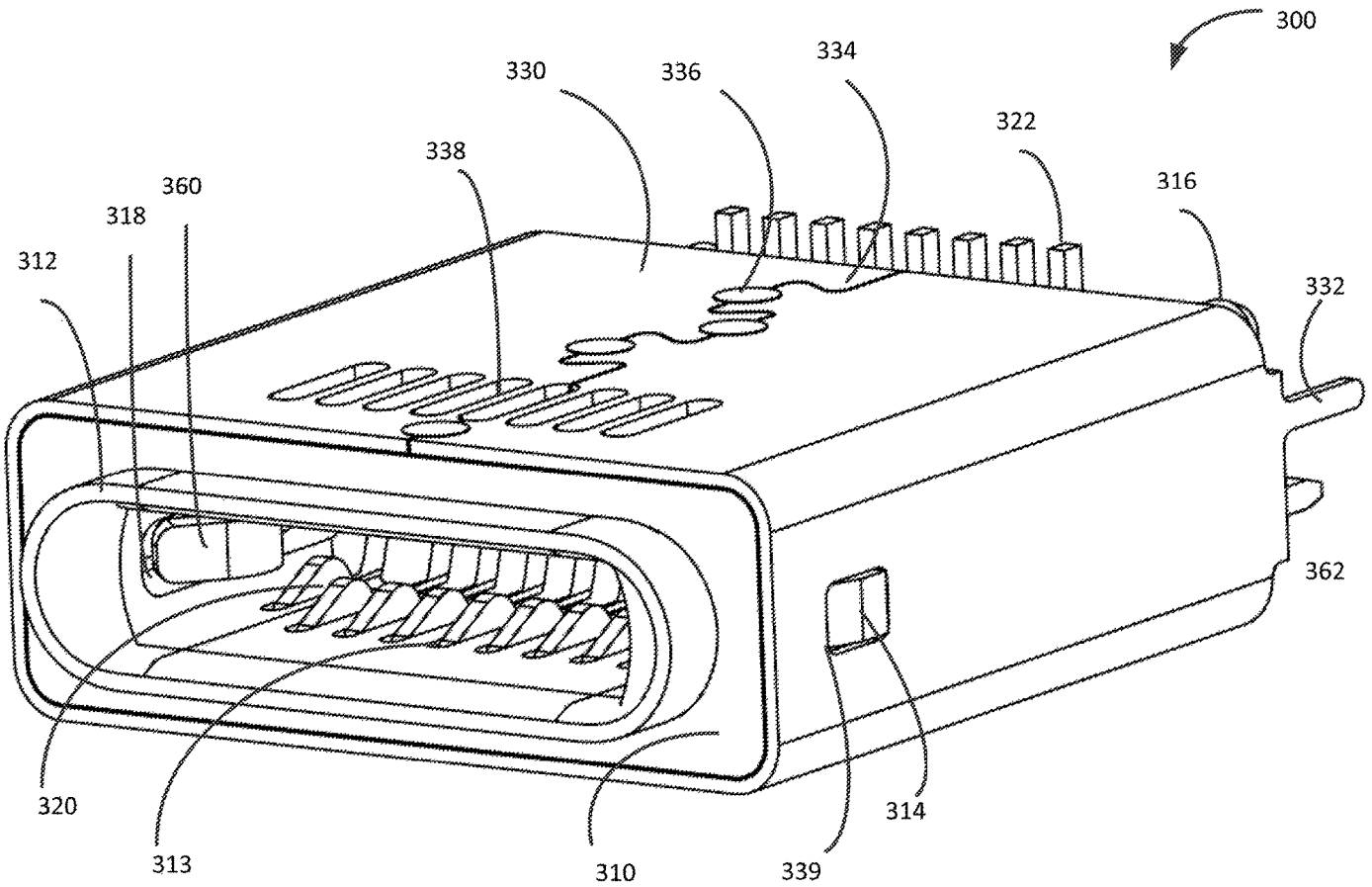
FIG. 23 illustrates another connector receptacle according to an embodiment of the present invention.

FIG. 23 illustrates another connector receptacle according to an embodiment of the present invention. Connector receptacle 300 may include housing 310 having a front guide 312 forming a front opening. As before, a connector insert may be inserted into the connector receptacle via the opening in front guide 312. A number of contacts 320 may be located in slots or passages 313 in housing 310. Side ground contacts 360 may be exposed at side openings 318 in housing 310. Housing 310 may include posts 316. Posts 316 may be placed in openings of a printed circuit board, device enclosure, or other appropriate substrate for mechanical stability.

Connector receptacle 300 may be at least partially covered by shell or shield 330. Shield portion 330 may include openings 338. Openings 338 may provide room for the deflection of contacts 320 when a connector insert is inserted into the connector receptacle 300. Shield 330 may be wrapped to form seam 334. The two sides of seam 334 may be sealed by spot or laser welding at locations 336. Shield portion 330 may further include tabs 332. Tabs 332 may be inserted into openings and connected to ground pads or traces in a printed circuit board or other appropriate substrate in an electronic device housing connector receptacle 300. A bottom side of shield portion 330 may include openings similar to openings 338.

Again, signals conveyed on contacts 320 may have a high data rates. Also, a relatively large number of signals may be packed into a fairly small connector receptacle 300. Accordingly, this and the other embodiments of the present invention may utilize various techniques for improving grounding. For example, side ground contacts 360 may be provided. Side ground contacts 360 may form ground connections with ground pads or a ground ring at the sides of a connector insert. As will be seen below, foil layers may be used to prevent high frequency leakage through openings 338. Further, contacts 320 may be used to convey differential signals. Typically, the differential signals may be located on adjacent contacts or pins. Contacts for AC signal grounds may be placed on each side of these adjacent contacts or pins. These AC grounds may include ground, power supplies, control lines, and other path having a low impedance to ground.

To further improve the signal integrity and quality, contacts 320 may be formed using a low impedance material. For example, an alloy of copper-nickel-silicon may be used. The resulting contacts 320 may have a lower impedance but may have a reduced beam spring force. Accordingly, embodiments of the present invention may compensate for this by using slightly longer contacts 320 than may otherwise be used. These longer contacts may have stronger beam force while maintaining a lower contact resistance.

Figure 24:
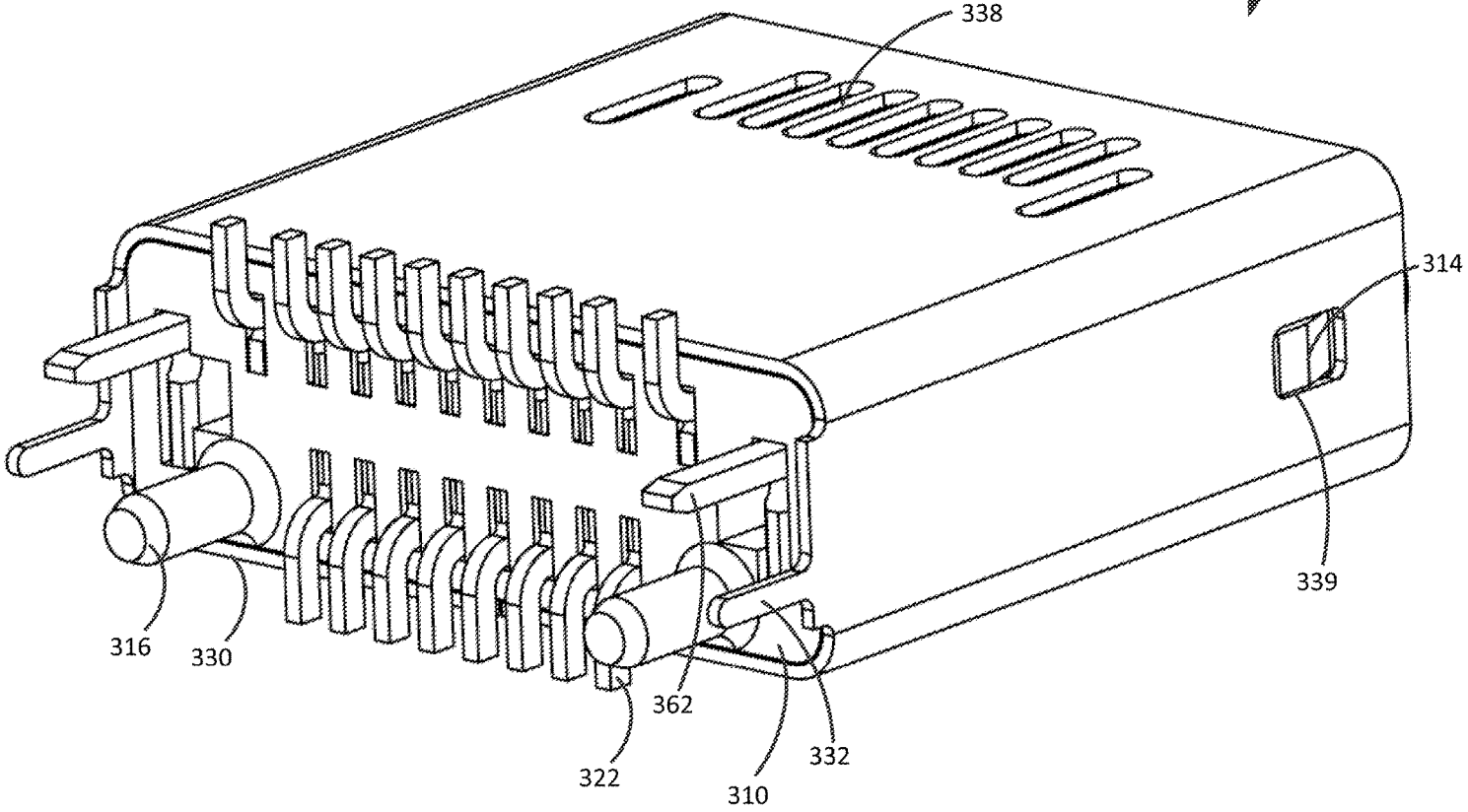
FIG. 24 illustrates an oblique bottom side view of the connector receptacle of FIG. 23.

FIG. 24 illustrates an oblique bottom side view of the connector receptacle of FIG. 23. Contact tails 322 for contacts 320 may emerge from an underside of housing 310. Contact tails 322 may be surface-mount contact tails which may be soldered to pads on a printed circuit board or other appropriate substrate. In other embodiments of the present invention, other types of contacts, such as through-hole contacts, may be used.

A shield portion 330 may be attached to housing 310. Shield portion 330 may include openings 338, which may be similar to openings 338 on a top side of connector receptacle 300. Shield portion 330 may include openings 339 to accept tab 314 on housing 310. Posts 316 and tabs 332 may also emerge from a bottom of connector receptacle 300. Posts 316 may be placed in openings in a printed circuit board or other substrate for mechanical stability. Tabs 332 and rear ground contact 362 for a side ground contact may be placed in openings connected to ground traces or planes in a printed circuit board or other substrate.

Figure 25:
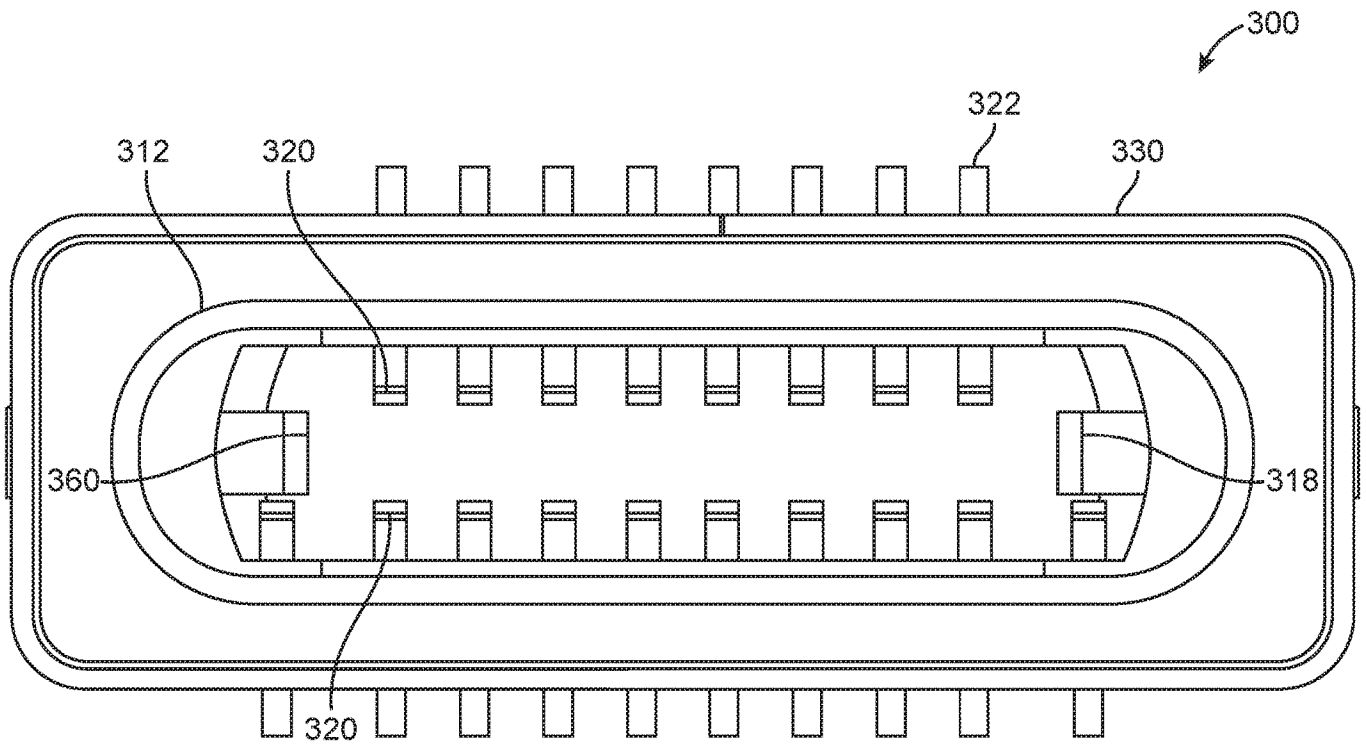
FIG. 25 illustrates a front view of the connector receptacle of FIG. 23.

FIG. 25 illustrates a front view of the connector receptacle of FIG. 23. Housing 310 may have an opening in a front guide 312 into which a connector insert may be inserted. Connector receptacle 300 may include contacts 320. Side ground contacts 360 may be available at side openings 318 in housing 310. While not shown here, a center ground plane or ground contact 392 may also be included as in the previous examples.

Figure 26:
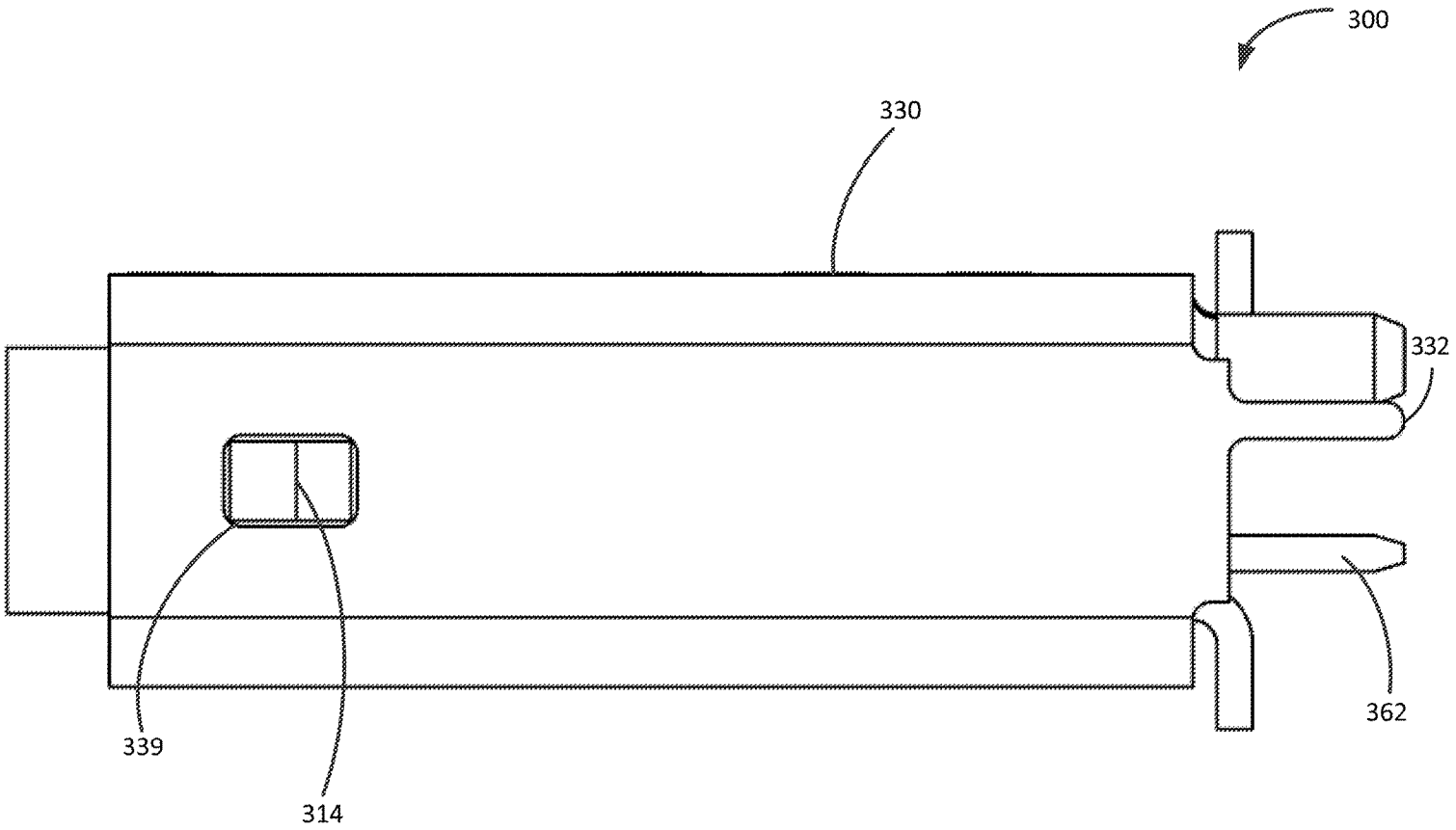
FIG. 26 illustrates a side view of the connector receptacle of FIG. 23.

FIG. 26 illustrates a side view of the connector receptacle of FIG. 23. Tab 314 on a housing may fit in opening 339 in shield 330 to secure shield 330 in place. Rear contact 362 for a side ground contact may be available at a back end of connector receptacle 300. Rear contact 362 and shield tab 332 may be placed in an opening in a printed circuit board and connected to ground.

Figure 27:
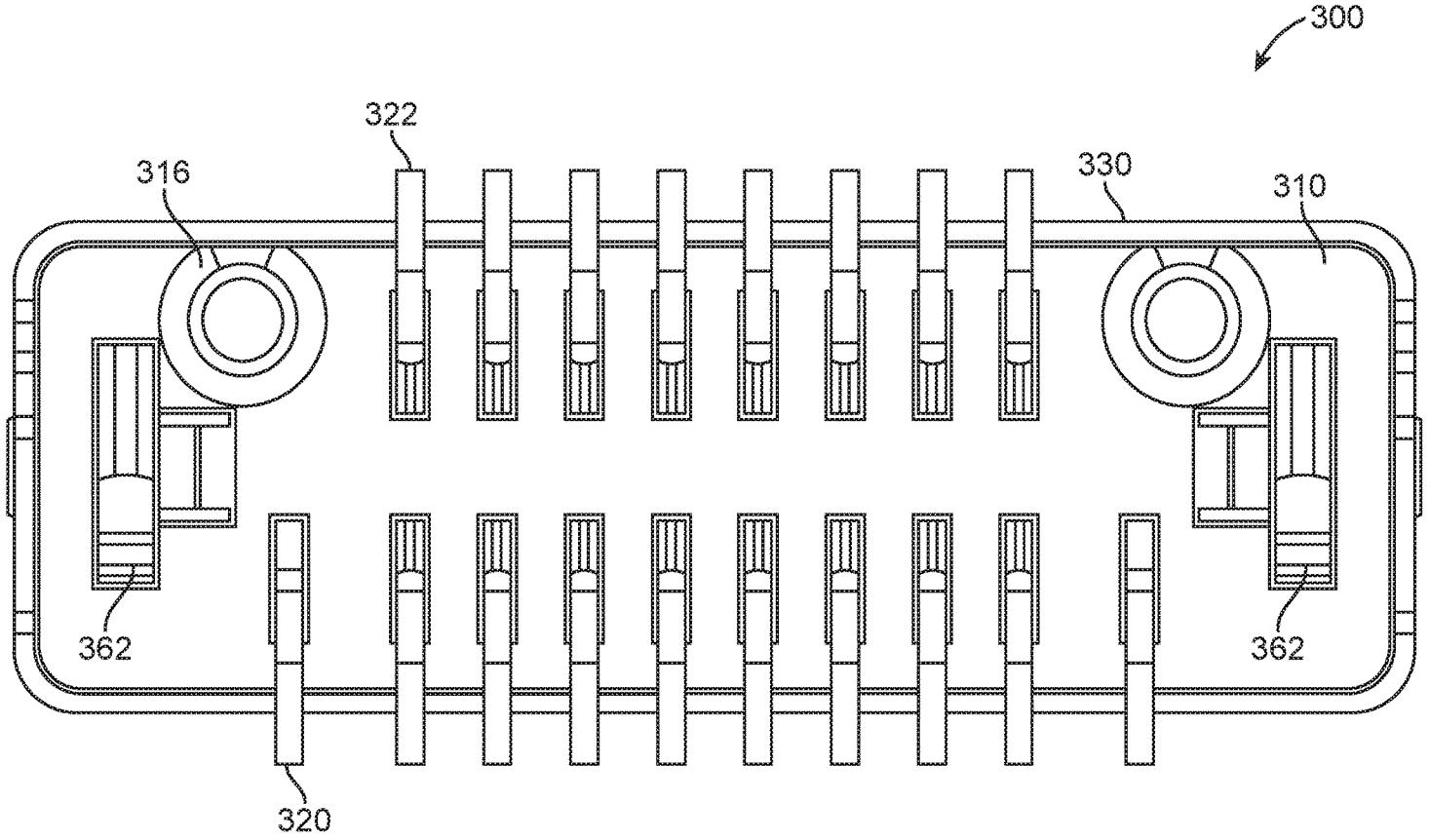
FIG. 27 illustrates a bottom view of the connector receptacle of FIG. 23.

FIG. 27 illustrates a bottom view of the connector receptacle of FIG. 23. Contact tails 322 for contacts 320 may emerge from a bottom of housing 310. Posts 316 and rear ground contacts 362 may also be available.

Figure 28:
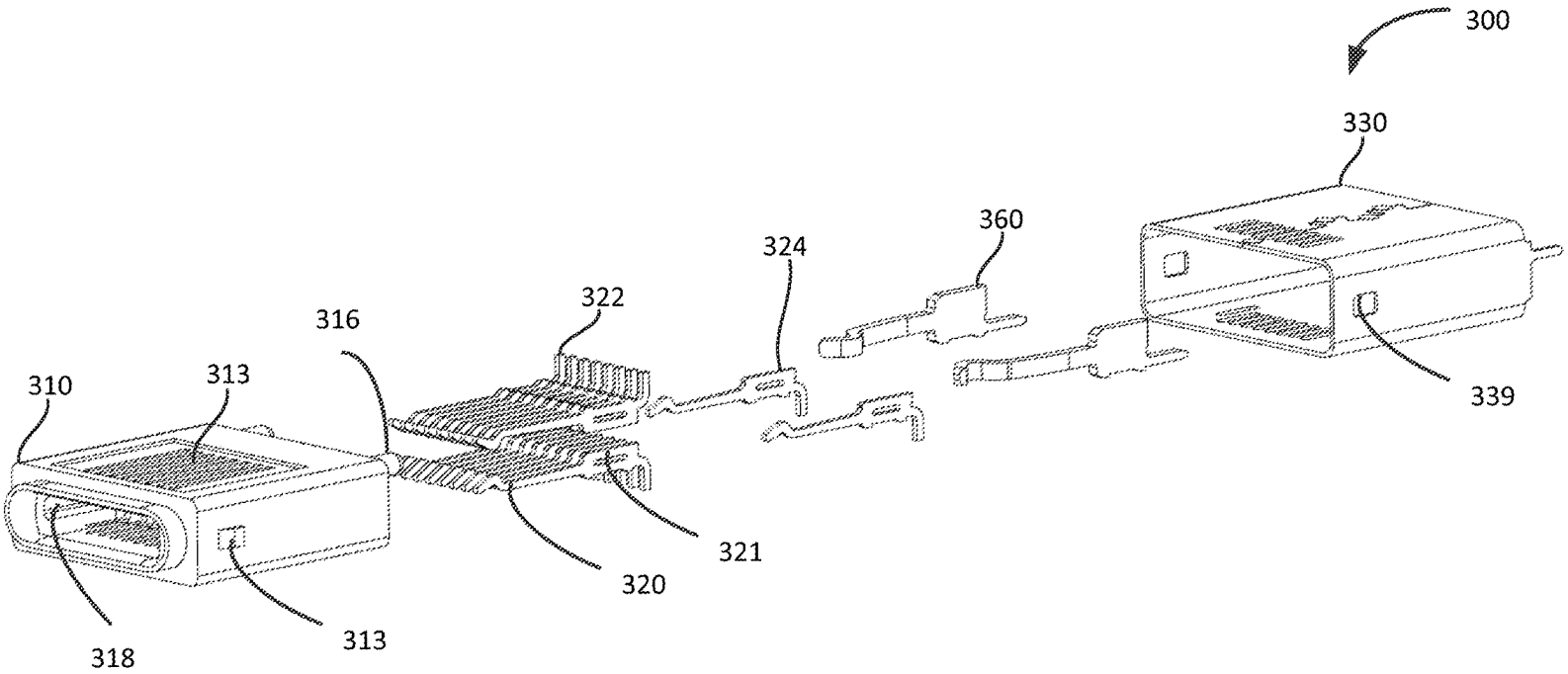
FIG. 28 illustrates an exploded view of the connector receptacle of FIG. 23.

FIG. 28 illustrates an exploded view of the connector receptacle of FIG. 23. Connector receptacle 300 may include contacts 320. Contacts 320 may have surface-mount or through-hole contacting tails. In this example, contacts 320 may have through-hole contacting tails 322.

The beam portions of contacts 320 may be fit into housing 310. Side ground contacts 360 may be placed in side openings of housing 310 such that side ground contacting portions 362 may be made available at openings 318 in sides of front housing portion 310.

Housing 310 may include grooves or slots 313 on a top and bottom side. Grooves or slot 313 may allow for the deflection of contacts 320 during the insertion of a connector insert. To prevent contacts 320 from contacting top shell portion 330, protective layers (not shown) may be used. These protective layers may be placed over slots or grooves 313. The protective layers may have an insulating side facing slots or grooves 313 to prevent electrical connections between pins. The protective layers may have a metallic foil layer to prevent high frequency leakage through openings 338 in a top of shield portion 330 and corresponding openings in a bottom of shield portion 330.

Shield portion 330 may be placed over housing 310. Tabs 313 on housing 310 may be aligned with openings 339 in shield 330 to secure shield 330 in place relative to housing 310.

Figure 29:
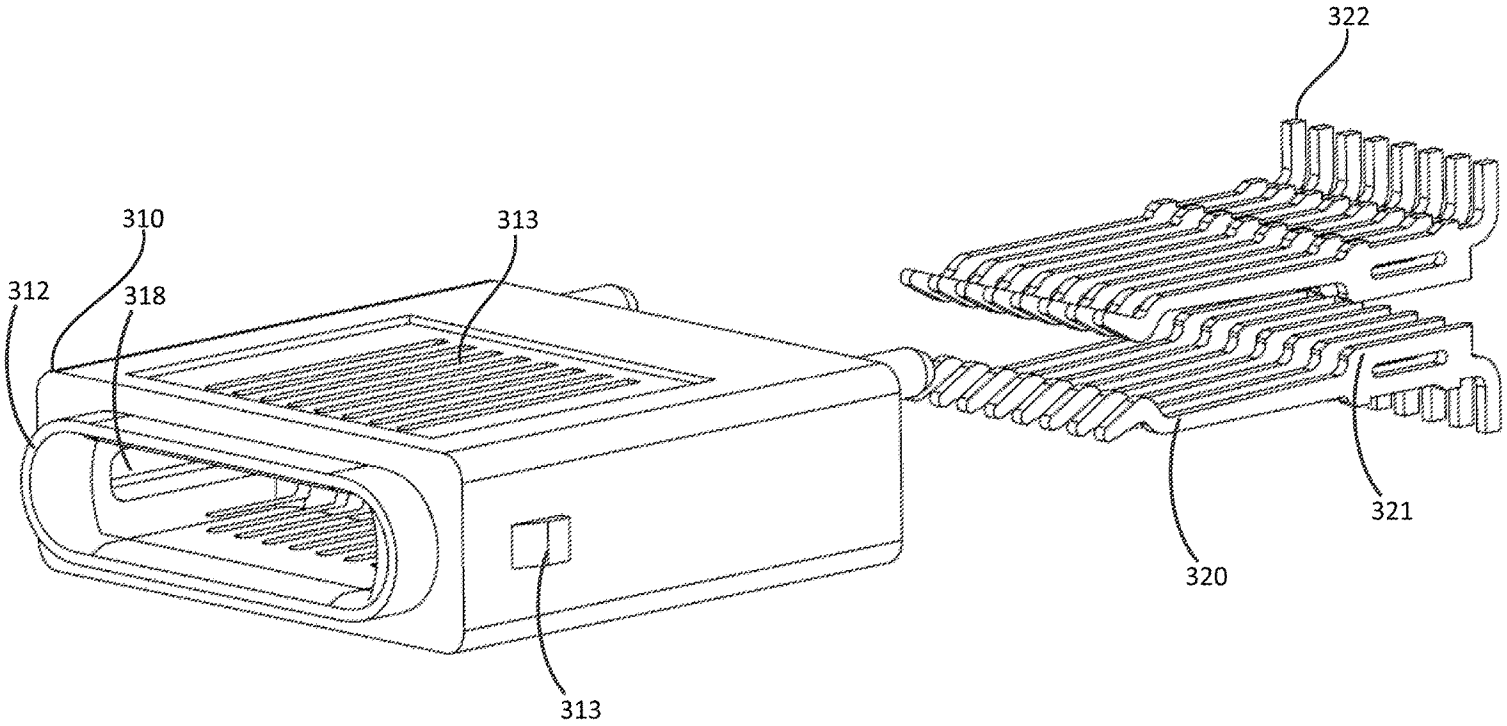
FIG. 29 illustrates a housing and contacts that may be used as the housing and contacts for the connector receptacle of FIG. 23.

FIG. 29 illustrates a housing and contacts that may be used as the housing and contacts for the connector receptacle of FIG. 23. Housing 310 may include a front guide portion 312 and slots 313 in a top and bottom surface. Slots 313 may accept contacts 320 and provide contacts room for the contacts to deflect when a connector insert is inserted. Side ground contacts may be inserted into side passages in housing 310 such that contacting portions are exposed at openings 318. Tabs 313 may fit in an opening on a shield to secure a shield in place with housing 310. Contacts 320 may include contact tails 312. Contacts 320 may include wide mechanical stabilizing portions 320.

Figure 30:
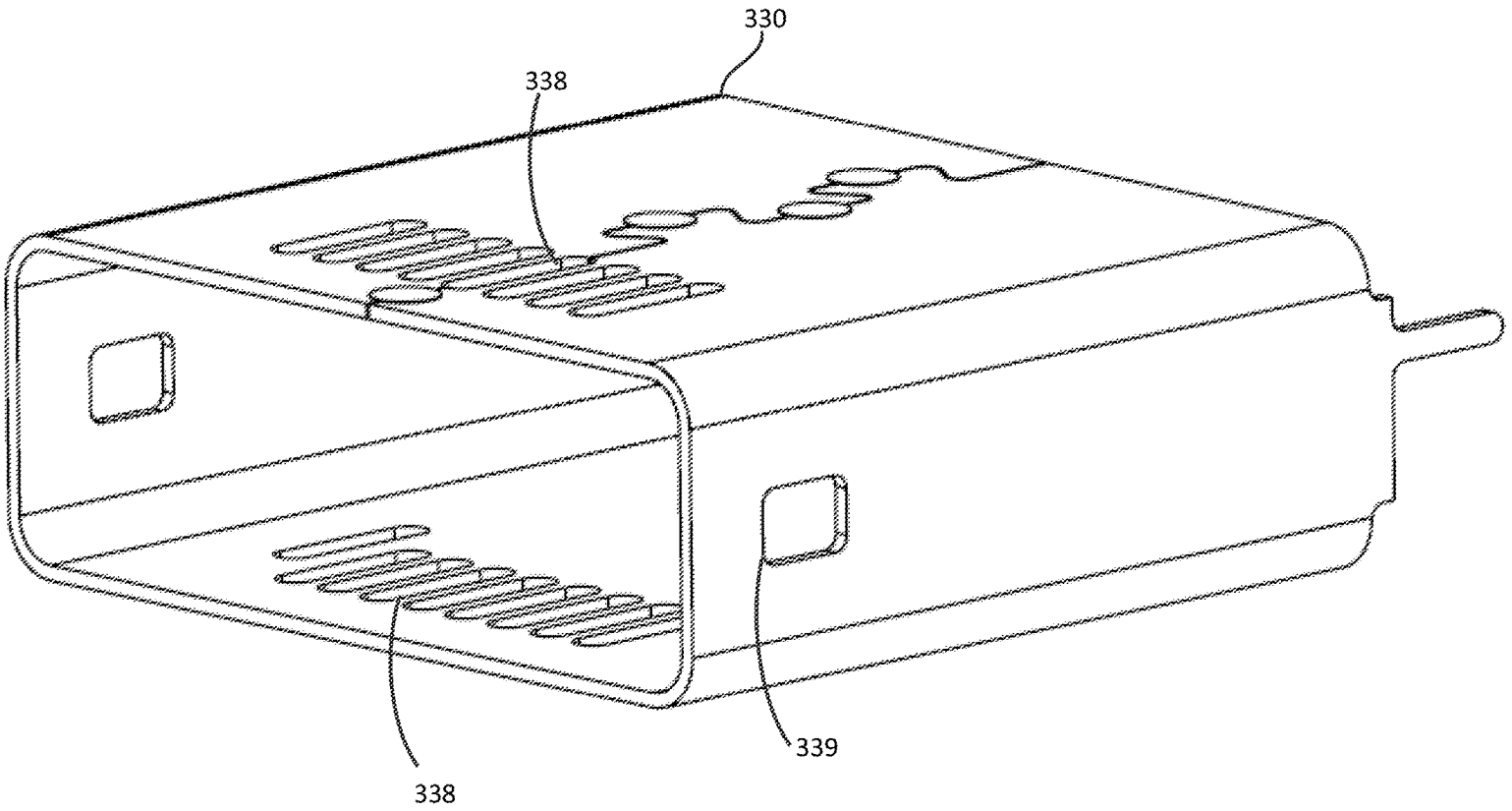
FIG. 30 illustrates a shield that may be used as a shield for the connector receptacle and in FIG. 23.

FIG. 30 illustrates a shield that may be used as a shield for the connector receptacle and in FIG. 23. Shield 230 may include top and bottom openings 338. Top and bottom openings 338 may provide room for the deflection of contacts during insertion of a connector insert. Opening 339 may accept a tab on the side of a housing when a housing is inserted into shield 330.

Embodiments of the present invention may communicate with one or more different types of connector inserts. One such connector insert is the Lightning connector insert. Lightning connectors are reversible. That is, a Lightning connector insert may be inserted into a Lightening receptacle in one of two orientations. An example of a Lightning connector insert is shown in the following figure. This same physical arrangement may be used to convey signals for other types of interfaces as well. For example, HDMI, USB, Thunderbolt, DisplayPort, and other types of interfaces may be convey using the same physical connector insert arrangement, though various circuits and interconnects connected to the connector insert may be different and the contacts may or may not be reversible.

Figure 31:
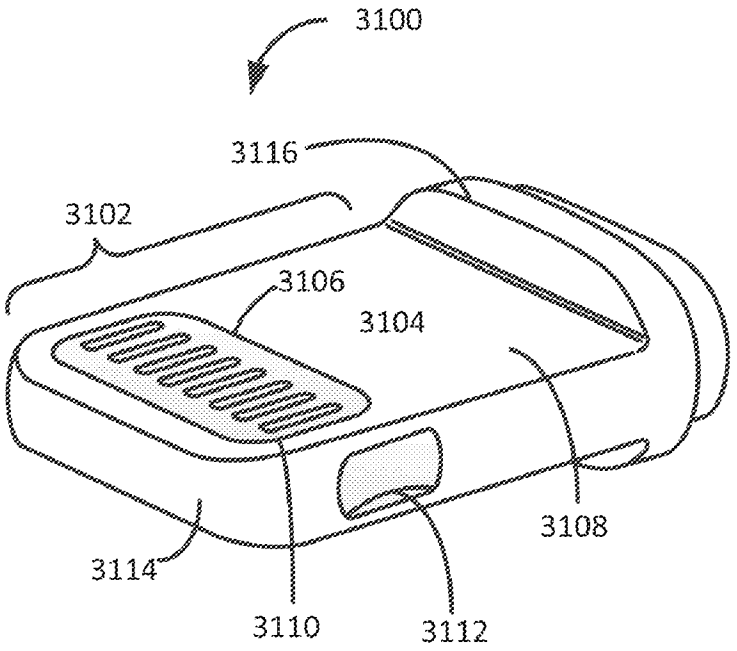
FIG. 31 illustrates a connector insert that may be employed and received by embodiments the present invention.

FIG. 31 illustrates a Lightning connector insert that may be employed and received by embodiments the present invention. Specifically, this connector may be used as a connector insert to plug into the above connector receptacles.

Connector insert 3100 may include insert portion or tab 3102. Tab 3102 may be sized to be inserted into a corresponding receptacle connector during a mating event and may include a first contact region 3106 formed on a first major surface 3104 and a second contact region (not shown) formed at a second major surface (also not shown) opposite surface 3104. Surface 3104 may extend from a distal tip 3114 of tab 3102 to spine 3116 that, when tab 3102 is inserted into a corresponding receptacle connector, abuts a housing of the receptacle connector or portable computing device that the receptacle connector is incorporated in. Tab 3102 may also include first and second opposing side surfaces that extend between the first and second major surfaces including 3104.

A plurality of contacts 3110 can be formed in each of contact regions 3106 on each side of tab 3102 such that, when tab 3102 is inserted into a corresponding receptacle connector, contacts 3106 are electrically coupled to corresponding contacts in the receptacle connector. In some embodiments, contacts 3106 are self-cleaning wiping contacts that, after initially coming into contact with a receptacle connector contact during a mating event, slide further past the receptacle connector contact with a wiping motion before reaching a final, desired contact position.

The structure and shape of tab 3102 may be defined by a ground ring 3108 that can be made from stainless steel or another hard conductive material. Connector 3100 may include retention feature 3112 and a corresponding feature on the opposite side of tab 3102 formed as curved pockets in the sides of ground ring 3108 that may double as ground contacts.

The numbers pins or contacts and pins assignments may vary. Specific pinouts that may be used for these plugs and receptacles can be found in co-pending U.S. patent application Ser. No. 13/607,366, filed Sep. 7, 2012, titled DUAL ORIENTATION ELECTRONIC CONNECTOR, which is incorporated by reference.

In various embodiments of the present invention, the components of the receptacles may be formed in various ways of various materials. For example, contacts or pins and other conductive portions of the receptacles may be formed by stamping, metal-injection molding, machining, micromachining, 3-D printing, or other manufacturing process. The conductive portions may be formed of stainless steel, steel, copper, copper titanium, phosphor bronze, a copper-nickel-silicon alloy, or other material or combination of materials. The conductive portions, such as the shields, may be joined together using soldering, spot or laser welding, or other technique. The conductive portions may be plated or coated with nickel, gold, or other material. The nonconductive portions, such as the protective pieces, the receptacle housings and other portions, may be formed using injection or other molding, 3-D printing, machining, or other manufacturing process. The nonconductive portions may be formed of silicon or silicone, rubber, hard rubber, plastic, nylon, elastomers, liquid-crystal polymers (LCPs), ceramics, or other nonconductive material or combination of materials.

Embodiments of the present invention may provide receptacles that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These connector receptacles may provide pathways for signals and power for cards or other modules, such as Secure Digital cards, Secure Digital High Capacity cards, Secure Digital Extended Capacity cards, Secure Digital Ultra-High-Capacity I cards, Secure Digital Ultra-High-Capacity II cards, memory sticks, compact flash cards, communication modules, and other devices and modules that have been developed, are being developed, or will be developed in the future. These connector receptacles may provide pathways for signals that are compliant with various standards such as Universal Serial Bus (USB), High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future.

Various embodiments of the present invention have been shown above. The features, such as front ground contacts, split shield portions, center ground contacts or planes, surface mount and through-hole contacts, and other features have been shown in the context of specific embodiments, though various other embodiments of the present invention may provide connector receptacles that mix and match these various features in other combinations.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector receptacle comprising:

a housing having a front side opening and two side openings;

a top row of contacts in a top side of the housing near the front side opening;

a bottom row of contacts in a bottom side of the housing near the front side opening;

a ground contact between the top row of contacts and the bottom row of contacts;

two side ground contacts, one on each side of the housing, each having a contact portion exposed at a side opening of the housing; and a shield substantially around the housing, wherein the housing has a front guide portion defining the front side opening and extending forward beyond the shield, the shield comprising a plurality of extensions extending from a front edge of the shield and folded to fit in openings in the front guide portion of the housing.

2. The connector receptacle of claim 1 wherein the ground contact between the top row of contacts and the bottom row of contacts is arranged to electrically connect to a front edge of a connector insert when the connector insert is inserted into the connector receptacle.

3. The connector receptacle of claim 2 wherein the plurality of extensions form ground contacts to mate with a ground ring on a connector insert when the connector insert is inserted into the connector receptacle.

4. The connector receptacle of claim 1 wherein the shield further comprises a top shield portion having openings, each opening located over a contact in the top row of contacts.

5. The connector receptacle of claim 4 wherein the shield further comprises a bottom shield portion having openings, each opening located over a contact in the bottom row of contacts.

6. The connector receptacle of claim 5 further comprising a first layer of insulating material and a first layer of metallic foil between the top row of contacts and the top shield portion and a second layer of insulating material and a second layer of metallic foil between the bottom row of contacts and the bottom shield portion.

7. The connector receptacle of claim 6 wherein the top shield portion is formed using a deep drawing manufacturing process.

8. The connector receptacle of claim 1 wherein each of the contacts comprises a beam portion and a through-hole portion.

9. The connector receptacle of claim 8 wherein the housing comprises a front portion and a rear interlocking portion, wherein the beams of the contacts are located in the front portion of the housing and the through-hole portions of the contacts are at least partially located in the rear interlocking portion.

10. The connector receptacle of claim 9 wherein the contacts are formed of a copper-nickel-silicon alloy.

11. The connector receptacle of claim 1 wherein the shield is notched near the extensions.

12. A method of assembling a connector receptacle, the method comprising:

forming a first mold around a first plurality of contacts;

forming a second mold around a second plurality of contacts;

aligning a ground plane portion between the first mold and the second mold and attaching the first mold to the second mold;

inserting contact tails for the first plurality of contacts, the ground plane portion, and the second plurality of contacts into a rear housing portion;

inserting beam portions of the first plurality of contacts, the ground plane portion, and the second plurality of contacts into a front housing portion and attaching the front housing portion to the rear housing portion;

inserting side ground contacts into sides of the rear housing portion;

placing a top shield portion over a top of the attached front and rear housings; and attaching a bottom shield portion under the attached front and rear housings.

13. The method of claim 12 wherein the first mold and the second mold are formed using insert molding.

14. The method of claim 13 further comprising:

before placing a top shield portion over a top of the attached front and rear housings, placing a first protective layer over openings in a top of the front housing portion; and before attaching a bottom shield portion under the attached front and rear housings, placing a second protective layer over openings in a bottom of the front housing portion.

15. The method of claim 14 wherein the first protective layer and the second protective layer each include a metallic foil layer.

16. The method of claim 12 wherein placing a top shield portion over a top of the attached front and rear housings further comprises:

inserting a plurality of contacts extending from the top shield portion through corresponding openings in a top of the front housing portion; and wherein placing a top shield portion over a top of the attached front and rear housings further comprises:

inserting a plurality of contacts extending from the bottoms shield portion through corresponding openings in a bottom of the front housing portion.

17. A connector receptacle comprising:

a front housing portion attached to a rear housing portion;

a first mold around a first plurality of contacts;

a second mold around a second plurality of contacts and attached to the first mold;

a ground plane portion between the first mold and the second mold and attached to the first mold to the second mold, a plurality of side ground contacts inserted into sides of the rear housing portion;

a top shield portion placed over a top of the attached front and rear housings; and a bottom shield portion placed under the attached front and rear housings and attached to the top shield portion, wherein portions of contact tails for the first plurality of contacts, the ground plane portion, and the second plurality of contacts are located in passages in the rear housing portion, and wherein beam portions of the first plurality of contacts, the ground plane portion, and the second plurality of contacts are located in the front housing portion.

18. The connector receptacle of claim 17 wherein the ground plane portion between the first mold and the second mold is arranged to electrically connect to a front edge of a connector insert when the connector insert is inserted into the connector receptacle.

19. The connector receptacle of claim 17 further comprising a first layer of insulating material and a first layer of metallic foil between the first plurality of contacts and the top shield portion and a second layer of insulating material and a second layer of metallic foil between the second plurality of contacts and the bottom shield portion.

20. The connector receptacle of claim 19 wherein the top shield portion is formed using a deep drawing manufacturing process.

* * * * *